US011629303B2

(12) United States Patent
Cenacchi Peirera et al.

(10) Patent No.: US 11,629,303 B2
(45) Date of Patent: Apr. 18, 2023

(54) QUATERNARY FATTY AMIDOAMINE COMPOUND FOR USE AS AN ADDITIVE FOR FUEL

(71) Applicant: TOTAL MARKETING SERVICES, Puteaux (FR)

(72) Inventors: Ana Maria Cenacchi Peirera, St. Genis Laval (FR); Julie Prevost, Lyons (FR); Michaël Mazarin, Vaulx en Velin (FR); Jérôme Obiols, Feyzin (FR); Julien Sanson, Charly (FR)

(73) Assignee: TOTAL MARKETING SERVICES, Puteaux (FR)

( * ) Notice: Subject to any disclaimer, the term of this patent is extended or adjusted under 35 U.S.C. 154(b) by 0 days.

(21) Appl. No.: 17/298,742

(22) PCT Filed: Nov. 29, 2019

(86) PCT No.: PCT/EP2019/083118
§ 371 (c)(1),
(2) Date: Jun. 1, 2021

(87) PCT Pub. No.: WO2020/109568
PCT Pub. Date: Jun. 4, 2020

(65) Prior Publication Data

US 2022/0056360 A1 Feb. 24, 2022

(30) Foreign Application Priority Data

Nov. 30, 2018 (EP) ..... 18306589

(51) Int. Cl.
*C10L 1/224* (2006.01)
*C10L 10/06* (2006.01)
*C10L 1/222* (2006.01)

(52) U.S. Cl.
CPC ..... *C10L 1/224* (2013.01); *C10L 10/06* (2013.01); *C10L 1/2222* (2013.01); *C10L 2200/0423* (2013.01); *C10L 2200/0446* (2013.01); *C10L 2230/22* (2013.01)

(58) Field of Classification Search
CPC ..... C10L 10/04; C10L 10/06; C10L 10/08; C10L 10/18; C10L 1/2222; C10L 1/224; C10L 2200/0423; C10L 2200/0446; C10L 2230/086; C10L 2230/22; C10L 2270/023; C10L 2270/026
See application file for complete search history.

(56) References Cited

U.S. PATENT DOCUMENTS

| | | | | |
|---|---|---|---|---|
| 4,171,959 | A | 10/1979 | Vartanian | |
| 10,351,791 | B2 | 7/2019 | Reid et al. | |
| 10,370,610 | B2 | 8/2019 | Hansch et al. | |
| 2004/0093789 | A1* | 5/2004 | Hart | C10L 1/143 44/301 |
| 2005/0037942 | A1* | 2/2005 | Otterson | C11D 1/94 510/499 |
| 2006/0135881 | A1 | 6/2006 | Giftakis et al. | |
| 2013/0041075 | A1 | 2/2013 | Harders et al. | |
| 2013/0239468 | A1 | 9/2013 | Greenfield et al. | |
| 2015/0096528 | A1 | 4/2015 | Schwab et al. | |
| 2015/0113863 | A1 | 4/2015 | Papin et al. | |
| 2016/0186084 | A1* | 6/2016 | Schilowitz | C10M 169/044 508/370 |
| 2017/0058225 | A1 | 3/2017 | Papin et al. | |
| 2017/0247624 | A1 | 8/2017 | Papin et al. | |
| 2018/0030363 | A1 | 2/2018 | Prevost et al. | |
| 2018/0030364 | A1 | 2/2018 | Prevost et al. | |
| 2018/0079976 | A1 | 3/2018 | Tort et al. | |
| 2018/0258357 | A1 | 9/2018 | Prevost | |
| 2018/0265793 | A1 | 9/2018 | Prevost | |
| 2018/0273861 | A1 | 9/2018 | Prevost | |
| 2018/0355267 | A1 | 12/2018 | Moreton et al. | |
| 2018/0371345 | A1 | 12/2018 | Prevost | |
| 2019/0002780 | A1 | 1/2019 | Prevost | |
| 2019/0046941 | A1 | 2/2019 | Sullivan et al. | |
| 2019/0153343 | A1 | 5/2019 | Prevost | |
| 2019/0169516 | A1 | 6/2019 | Prevost | |
| 2020/0208070 | A1 | 7/2020 | Mazarin | |
| 2020/0332212 | A1 | 10/2020 | Prevost | |
| 2020/0362083 | A1 | 11/2020 | Gonzalez et al. | |
| 2020/0392421 | A1 | 12/2020 | Obiols | |
| 2020/0392422 | A1 | 12/2020 | Obiols | |
| 2021/0040407 | A1 | 2/2021 | Dauphin et al. | |
| 2021/0095217 | A1 | 4/2021 | Gonzales et al. | |

FOREIGN PATENT DOCUMENTS

| | | | |
|---|---|---|---|
| CN | 103328537 | A | 9/2013 |
| CN | 104024385 | A | 9/2014 |
| CN | 105579558 | A | 5/2016 |
| CN | 105722961 | A | 6/2016 |
| CN | 108699461 | A | 10/2018 |
| EP | 0871819 | A1 | 10/1998 |
| EP | 2631283 | A1 | 8/2013 |
| EP | 2796446 | A1 | 10/2014 |
| EP | 2987845 | A1 | 2/2016 |
| WO | WO-2006/135881 | A2 | 12/2006 |

* cited by examiner

*Primary Examiner* — Ellen M McAvoy
*Assistant Examiner* — Chantel L Graham
(74) *Attorney, Agent, or Firm* — Lorenz & Kopf, LLP

(57) ABSTRACT

The present invention relates to a fuel composition comprising a liquid fuel and a compound of dimer amide quaternary ammonium type. The invention also relates to the use of the compound of dimer amide quaternary ammonium type as a detergent additive in a liquid fuel for internal combustion engine.

18 Claims, No Drawings

QUATERNARY FATTY AMIDOAMINE COMPOUND FOR USE AS AN ADDITIVE FOR FUEL

CROSS-REFERENCE TO RELATED APPLICATIONS

This application is a National Stage of International Application No. PCT/EP2019/083118, filed Nov. 29, 2019, which claims priority to European Patent Office Patent Application No. 18306589.5, filed Nov. 30, 2018, which are both incorporated by reference herein.

FIELD

The present invention relates to a fuel composition comprising a liquid fuel and a quaternary fatty amidoamine compound. The present invention also relates to the use of the quaternary fatty amidoamine compound as an additive in a liquid fuel for an internal combustion engine. The invention also relates to a process for keeping clean and/or cleaning up at least one of the internal parts of an engine, in particular an internal combustion engine.

BACKGROUND

Liquid fuels for internal combustion engines contain components that can degrade during the functioning of the engine. The problem of deposits in the internal parts of combustion engines is well known to motorists. It has been shown that the formation of these deposits has consequences on the performance of the engine and in particular a negative impact on consumption and particle emissions. Progress in the technology of fuel additives has made it possible to face up to this problem.

"Detergent" additives used in fuels have already been proposed to keep the engine clean by limiting deposits ("keep-clean" effect) or by reducing the deposits already present in the internal parts of the combustion engine ("clean-up" effect). Mention may be made, for example, of U.S. Pat. No. 4,171,959 which describes a detergent additive for gasoline fuel containing a quaternary ammonium function. WO 2006/135881 describes a detergent additive containing a quaternary ammonium salt used for reducing or cleaning deposits, especially on the inlet valves.

However, engine technology is in constant evolution and the stipulations for fuels must evolve to cope with these technological advances of combustion engines. In particular, the novel gasoline or diesel direct-injection systems expose the injectors to increasingly severe pressure and temperature conditions, which promotes the formation of deposits. In addition, these novel injection systems have more complex geometries to optimize the spraying, especially, from more numerous holes having smaller diameters, but which, on the other hand, induce greater sensitivity to deposits. The presence of deposits may impair the combustion performance and in particular increase pollutant emissions and particle emissions. Other consequences of the excessive presence of deposits have been reported in the literature, such as the increase in fuel consumption and handling problems.

Preventing and reducing deposits in these novel engines are essential for optimum functioning of modern engines. There is thus a need to propose detergent additives for fuel which promote optimum functioning of combustion engines, especially for novel engine technologies.

In indirect injection spark-ignition internal combustion engine (also name gasoline engine), a specific problem can occur, which is linked to the formation of deposits on the external parts of the engine, in particular on the intake valve stems of the mixture of air and fuel upstream the combustion chamber. This problem leads to a valve sticking phenomenon. This phenomenon, well known for the specialists, is described in the reference publication of Seppo Mikkonen, Reino Karlsson and Jouni Kivi titled«Intake Valve Sticking in Some Carburetor Engines», SAE Technical Paper Series no. 881643, International Fuels and Lubricants Meeting and Exposition, Portland, Oreg., Oct. 10-13, 1988.

This phenomenon is caused, during operation of the engine at low temperatures (in cold weather for example), by an accumulation of deposits having a high viscosity at the interface between the intake valve stem and the valve guide, in the spark ignition engines with indirect injection. The accumulation of such deposits on the valve stems hinders the movements of the latter, the stems stick to the valve guides, which causes a poor closing of the valves, causes problems of sealing in the combustion chamber, and can affect importantly the operation of the engine, and in particular can prevent it from starting in cold weather.

There are different types of deposits on intake valves of indirect injection spark ignition engines. These types of deposits are well known to engine manufacturers, and the appearance of some deposits is dependent on the solutions for treating other deposits.

On the one hand, a first type of deposit consists of those formed at high temperature on the intake valves of indirect-injection spark-ignition engines when a fuel containing no detergent additive is used. These deposits consist in particular of carbon residues related to the phenomenon of coking and may also include soap-like deposits and/or varnish (also named lacquering deposits). These deposits are generally treated by the use of detergent additive added to the fuel (additive-containing fuel).

On the other hand, a second type of deposit consists of viscous deposits, mentioned above, which are formed at low temperature and appearing on the intake valves of indirect injection spark ignition engines when using fuel with additives, thus causing the sticking phenomenon of the valves described above. Thus, the fuel additive used for the treatment and prevention of deposits that form at high temperatures can cause the appearance of viscous deposits at low temperatures.

Indeed, as stated in the aforementioned publication (SAE Technical Paper Series No. 881643), the composition of the gasoline and the additives it contains have a very important influence on the valve sticking phenomena. In particular, detergent additives conventionally incorporated in gasolines to preserve the cleanliness of the valves paradoxically have been found to promote sticking phenomena thereof. More specifically, the problem of valve sticking does not occur or very little when a fuel free of detergent additives is used. As an example, the aforementioned publication shows that the polymeric type additives, which can be used in engine gasoline and/or oils to reduce some kinds of deposits, are known as promoters of valve sticking.

Document EP 0871819 suggests the use of a Mannich base in order to prevent the valve sticking phenomenon. However, this document also suggests the incorporation of the additive into a carrier oil in order to obtain a satisfying effect. Thus, there is also a need for a universal detergent additive that is capable of acting on different kinds of deposits irrespective of the technology of the engine and/or the nature of the fuel.

SUMMARY

The present invention relates to a fuel composition comprising:

(i) a liquid fuel, and (ii) a compound of formula (I):

(I)

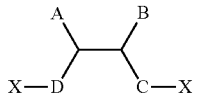

wherein

A, B, C and D represent, independently to each other, an alkyl or an alkenyl group with a number of carbon atoms resulting in a molar mass of A+B+C+D ranging from 84 to 10000 g/mol, being understood that A is optionally hydrogen, X represents the monovalent radical of formula (II):

(II)

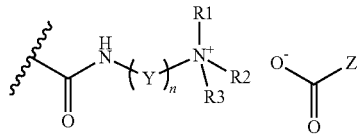

wherein:

R1, R2, R3, identical or different, represent $C_1$-$C_{20}$ linear or branched, saturated or unsaturated, cyclic or acyclic, hydrocarbyl group;

Y represents a $C_1$-$C_{20}$ linear or branched, saturated or unsaturated, hydrocarbyl group optionally substituted by a functional group comprising oxygen and/or a nitrogen atom(s);

n represents an integer ranging from 1 to 20;

Z represents a $C_1$-$C_{16}$, linear or branched, saturated or unsaturated, cyclic or acyclic, hydrocarbyl group optionally substituted by a functional group comprising an oxygen and/or a nitrogen atom.

According to an embodiment, the compound of formula (I) has one or several of the following features:

Z is selected from alkyl, alkenyl or aryl group, optionally substituted by a functional group comprising oxygen and/or a nitrogen atom(s), having a molar mass strictly less than 237 g/mol, preferably less than 210 g/mol.

Y represents a $C_1$-$C_{12}$ linear or branched, saturated or unsaturated, hydrocarbyl group constituted by carbon atoms and hydrogen atoms and/or n ranges from 1 to 6.

A, B, C and D represent, independently to each other, an alkyl or an alkenyl group with a number of carbon atoms resulting in a molar mass of A+B+C+D ranging from 84 to 2000 g/mol, preferably from 84 to 1000 g/mol.

R1, R2, R3 are identical and selected from alkyl groups having from 1 to 12 carbon atoms, preferably from alkyl groups having from 1 to 6 carbon atoms, more preferably from methyl, ethyl and propyl groups.

According to an embodiment, the compound of the fuel composition is of formula (Ib):

(Ia)

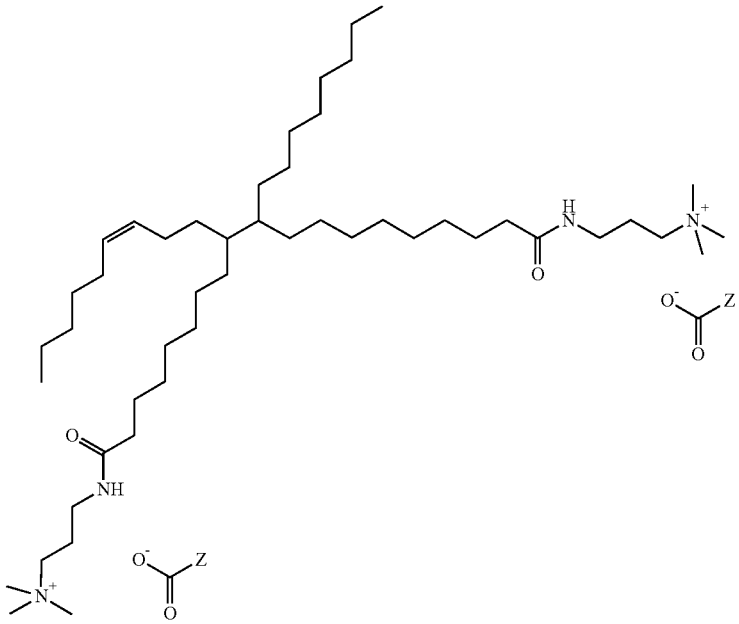

wherein Z represents a $C_1$-$C_{16}$, linear or branched, saturated or unsaturated, cyclic or acyclic, aliphatic or aromatic hydrocarbyl group optionally substituted by a functional group comprising an oxygen and/or a nitrogen atom, preferably a group selected from a methyl group, a n-pentyl group, ortho-hydroxyphenyl, —$(CH_2)_{10-12}CH_3$ and heptadec-8-enyl, more preferably from ortho-hydroxyphenyl and —$(CH_2)_{10-12}CH_3$, even more preferably from —$(CH_2)_{10-12}CH_3$.

According to an embodiment, the liquid fuel is selected from diesel fuels and gasoline fuels. According to an embodiment of the invention, the fuel composition comprises at least 5 ppm by weight of the compound of formula (I), preferably from 5 to 10000 ppm by weight of the compound of formula (I).

A second object of the invention relates to the use of a compound of formula (I) as defined above, as a detergent additive and/or as a demulsifying additive and/or as a lubricant additive and/or as a corrosion inhibitor additive and/or as an antioxidant additive and/or as a conductivity improver and/or as a metal deactivator, in a liquid fuel for internal combustion engine.

According to an embodiment, the liquid fuel is selected from diesel fuels and gasoline fuels. According to an embodiment, the compound(s) of formula (I) is(are) added in the liquid fuel in an amount of at least 5 ppm by weight, preferably an amount ranging from 5 to 10000 ppm by weight.

According to an embodiment, the compound of formula (I) is used in a liquid fuel to limit or prevent the formation of deposits in at least one of the internal parts of said engine and/or to reduce the existing deposits in at least one of the internal parts of said engine. According to an embodiment, the compound of formula (I) is used to reduce the fuel consumption of the engine. According to an embodiment, the compound of formula (I) is used in a liquid fuel to limit or prevent the valve-sticking phenomenon.

The compound of formula (I) defined in the present invention enables to greatly improve the detergency properties of a liquid fuel. The compound of formula (I) defined in the present invention can be used in diesel fuel as well as in gasoline fuel. The compound of formula (I) defined in the present invention allows keeping clean and cleaning up internal parts of engines in a very efficient way. The compound of formula (I) defined in the present invention allows reducing or preventing intake valve sticking phenomena, without the use of a carrier oil. The compound of formula (I) defined in the present invention can be used in a liquid fuel in order to reduce or prevent simultaneously the coking or lacquering type deposits and the valve sticking phenomenon.

DETAILED DESCRIPTION

The present invention concerns a fuel composition comprising:

(i) a liquid fuel, and (ii) one or more compounds of formula (I):

(I)

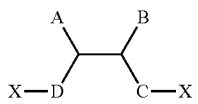

wherein

A, B, C and D represent, independently to each other, an alkyl or an alkenyl group with a number of carbon atoms resulting in a molar mass of A+B+C+D ranging from 84 to 10000 g/mol, being understood that A is optionally hydrogen, Each X represents independently to each other the monovalent radical of formula (II):

(II)

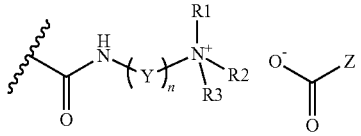

wherein:

each R1, R2, R3, identical or different, represent $C_1$-$C_{20}$ linear or branched, saturated or unsaturated, cyclic or acyclic, hydrocarbyl group;

each Y represents a $C_1$-$C_{20}$ linear or branched, saturated or unsaturated, hydrocarbyl group optionally substituted by a functional group comprising oxygen and/or a nitrogen atom(s);

each n represents an integer ranging from 1 to 20;

Z represents a $C_1$-$C_{16}$, linear or branched, saturated or unsaturated, cyclic or acyclic, hydrocarbyl group optionally substituted by a functional group comprising an oxygen and/or a nitrogen atom.

Preferably, both X groups in formula (I) are identical.

The term "alkyl group" means a group constituted by carbon and hydrogen atoms, without unsaturation. The alkyl group can be linear or branched. The alkyl group is acyclic (not cyclic).

The term "alkenyl group" means a group constituted by carbon and hydrogen atoms, with at least carbon-carbon double bond. The alkenyl group can be linear or branched. The alkenyl group is acyclic (not cyclic).

The term "hydrocarbyl group" means a group comprising carbon and hydrogen atoms and optionally heteroatoms, such as oxygen and/or nitrogen atoms. The hydrocarbyl group can be linear or branched, saturated or unsaturated, cyclic or acyclic, aliphatic or aromatic. Thus, the hydrocarbyl group can be an alkyl, an alkenyl or an aryl group, optionally substituted by heteroatom(s) or by alkyl or alkenyl branches.

The term "aryl group" means a group comprising at least one aromatic ring. The aromatic ring can be substituted by one or more groups selected from hydroxyl group, alkyl group comprising preferably from 1 to 6 carbon atoms, alkoxyl group comprising preferably from 1 to 6 carbon atoms. According to a particular embodiment of the invention, the term "aryl group" refers to a group comprising only one aromatic ring, optionally substituted by one or more groups selected from hydroxyl group, alkyl group comprising preferably from 1 to 6 carbon atoms, alkoxyl group comprising preferably from 1 to 6 carbon atoms.

In the formula (I) above, A, B, C and D represents, independently to each other, an alkyl or an alkenyl group with a number of carbon atoms resulting in a molar mass of A+B+C+D ranging from 84 to 10000 g/mol, being understood that A is optionally hydrogen. The molar mass of A+B+C+D corresponds to the sum of the molar mass of A, B, C and D groups. Preferably, the molar mass of A+B+C+D ranges from 84 to 2000 g/mol, more preferably from 84 to 1000 g/mol, even more preferably from 200 to 750 g/mol.

In an embodiment, A represents a hydrogen atom. According to a preferred embodiment, A is not a hydrogen atom.

According to an embodiment, A, B, C and D represents, independently to each other, an alkyl or an alkenyl group comprising from 2 to 16 carbon atoms, preferably from 4 to 12 carbon atoms. According to an embodiment, at least one among A, B, C and D groups represents an alkenyl group preferably comprising from 2 to 16 carbon atoms, more preferably from 4 to 12 carbon atoms. According to an embodiment, A or B is an alkenyl group preferably comprising from 2 to 16 carbon atoms, more preferably from 4 to 12 carbon atoms, even more preferably from 6 to 10 carbon atoms.

According to an embodiment, A and B are different groups. According to an embodiment, C and D are different groups. According to an embodiment, each A, B, C and D group comprises less than 4, preferably less than 3, more preferably less than 2, carbon-carbon double bonds. According to an embodiment, all A, B, C and D groups (considered together) comprise less than 4, preferably less than 3, more preferably less than 2, carbon-carbon double bonds.

In the formula (II) above, R1, R2, R3, identical or different, represent a $C_1$-$C_{20}$ linear or branched, saturated or unsaturated, cyclic or acyclic, hydrocarbyl group. According to an embodiment, the hydrocarbyl group is acyclic and constituted by carbon atoms and hydrogen atoms.

According to an embodiment, R1, R2 and R3, identical or different, represent a $C_1$-$C_{20}$ linear or branched alkyl or alkenyl group, preferably a $C_1$-$C_{20}$ linear or branched alkyl group, more preferably a $C_1$-$C_{20}$ linear alkyl group. According to an embodiment, R1, R2 and R3, identical or different, represent a $C_1$-$C_{12}$ linear or branched alkyl or alkenyl group, preferably a $C_1$-$C_{12}$ linear or branched alkyl group, more preferably a $C_1$-$C_{12}$ linear alkyl group. According to an embodiment, R1, R2 and R3, identical or different, represent a $C_1$-$C_6$ linear or branched alkyl or alkenyl group, preferably a $C_1$-$C_6$ linear or branched alkyl group, more preferably a $C_1$-$C_6$ linear alkyl group.

Preferably, R1, R2 and R3 are identical and represent a methyl, ethyl or propyl group, preferably a methyl group. In the formula (II) above, Y represents a $C_1$-$C_{20}$ linear or branched, saturated or unsaturated, hydrocarbyl group optionally substituted by a functional group comprising oxygen and/or a nitrogen atom(s). According to an embodiment, Y represents a $C_1$-$C_{12}$ linear or branched, saturated or unsaturated, acyclic hydrocarbyl group optionally substituted by a functional group comprising oxygen and/or a nitrogen atom(s).

According to an embodiment, Y represents a $C_1$-$C_{20}$ linear or branched, saturated or unsaturated, aliphatic hydrocarbyl group constituted by carbon atoms and hydrogen atoms. According to an embodiment, Y represents a $C_1$-$C_{20}$ linear or branched alkyl or alkenyl group, preferably a $C_1$-$C_{20}$ linear or branched alkyl group, more preferably a $C_1$-$C_{20}$ linear alkyl group. According to an embodiment, Y represents a $C_1$-$C_{12}$ linear or branched alkyl or alkenyl group, preferably a $C_1$-$C_{12}$ linear or branched alkyl group, more preferably a $C_1$-$C_{12}$ linear alkyl group. According to an embodiment, Y represents a $C_1$-$C_6$ linear or branched alkyl or alkenyl group, preferably a $C_1$-$C_6$ linear or branched alkyl group, more preferably a $C_1$-$C_6$ linear alkyl group, even more preferably a $C_1$-$C_4$ linear alkyl group.

In the formula (II) above, n represents an integer ranging from 1 to 20, preferably from 1 to 16, more preferably from 1 to 12, even more preferably from 1 to 8, ideally from 1 to 4. In the formula (II) above, Z represents a $C_1$-$C_{17}$, linear or branched, saturated or unsaturated, cyclic or acyclic, aliphatic or aromatic hydrocarbyl group optionally substituted by a functional group comprising an oxygen and/or a nitrogen atom. According to an embodiment of the invention, Z is selected from alkyl, alkenyl or aryl groups, optionally substituted by a functional group comprising oxygen and/or a nitrogen atom(s), having a molar mass strictly less than 237 g/mol, preferably less than 210 g/mol.

According to an embodiment, Z represents a group selected from:

- aryl groups optionally substituted by a functional group comprising oxygen and/or nitrogen atom(s),
- linear or branched alkenyl groups comprising from 2 to 17 carbon atoms, and
- linear or branched alkyl groups comprising from 1 to 16 carbon atoms.

According to an embodiment, Z represents a group selected from:

- aryl groups substituted by a functional group comprising oxygen and/or nitrogen atom(s),
- linear alkenyl groups comprising from 2 to 17 carbon atoms, and
- linear alkyl groups comprising from 1 to 16 carbon atoms.

According to an embodiment, Z represents a group selected from:

- a phenyl group substituted by a hydroxyl function preferably in ortho position,
- linear or branched, preferably linear, alkenyl groups comprising from 2 to 17 carbon atoms, and
- linear or branched, preferably linear, alkyl groups comprising from 1 to 16 carbon atoms.

According to an embodiment, Z represents a group selected from:

- a phenyl group optionally substituted by a functional group comprising oxygen and/or nitrogen atom(s), and
- linear or branched alkyl groups comprising from 1 to 16 carbon atoms.

According to an embodiment, Z represents a group selected from:

- a phenyl group substituted, preferably in ortho position, by a functional group comprising oxygen and/or nitrogen atom(s), preferably by a hydroxyl group, and
- linear alkyl groups comprising from 1 to 16 carbon atoms.

According to an embodiment, Z represents a $C_1$-$C_{16}$ linear or branched, saturated or unsaturated, aliphatic hydrocarbyl group optionally substituted by a functional group comprising an oxygen and/or a nitrogen atom.

According to an embodiment, Z represents a group selected from:

- linear or branched alkenyl groups comprising from 2 to 16 carbon atoms, preferably from 5 to 16 carbon atoms, and
- linear or branched alkyl groups comprising from 1 to 16 carbon atoms, preferably from 5 to 16 carbon atoms.

According to an embodiment, Z represents a group selected from linear or branched alkyl groups comprising from 1 to 18 carbon atoms, preferably from 5 to 16 carbon atoms. When the fuel composition comprises a mixture of at least two compounds of formula (I), the compounds of formula (I) preferably differs by the Z group. For example, if Z is an alkyl or an alkenyl group, the compounds of formula (I) can differ by the number of carbon atoms of the Z group.

According to a particular embodiment of the invention, the fuel composition comprises a compound of formula (Ia):

(Ia)

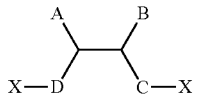

wherein

A, B, C and D represent, independently to each other, an alkyl or an alkenyl group comprising from 3 to 24 carbon atoms, preferably from 5 to 16 carbon atoms, and preferably at least one among A, B, C and D represents an alkenyl group;

X represents the monovalent radical of formula (II):

(IIa)

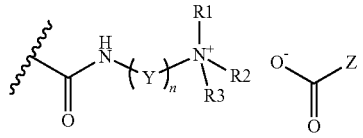

wherein:

R1, R2, R3, identical or different, represent a linear alkyl or alkenyl group comprising from 1 to 8 carbon atoms, preferably a linear alkyl group comprising from 1 to 6 carbon atoms;

Y represents a linear alkyl or alkenyl group comprising from 1 to 8 carbon atoms, preferably a linear alkyl group comprising from 1 to 6 carbon atoms;

n represents an integer ranging from 1 to 6;

Z represents a group selected from:

aryl groups optionally substituted by a functional group comprising oxygen and/or nitrogen atom(s), such as a hydroxyl function, linear or branched alkenyl groups comprising from 1 to 16 carbon atoms, and linear or branched alkyl groups comprising from 1 to 16 carbon atoms.

According to an embodiment, the compound of formula (I) is selected from compounds of formula (Ib) below:

(Ib)

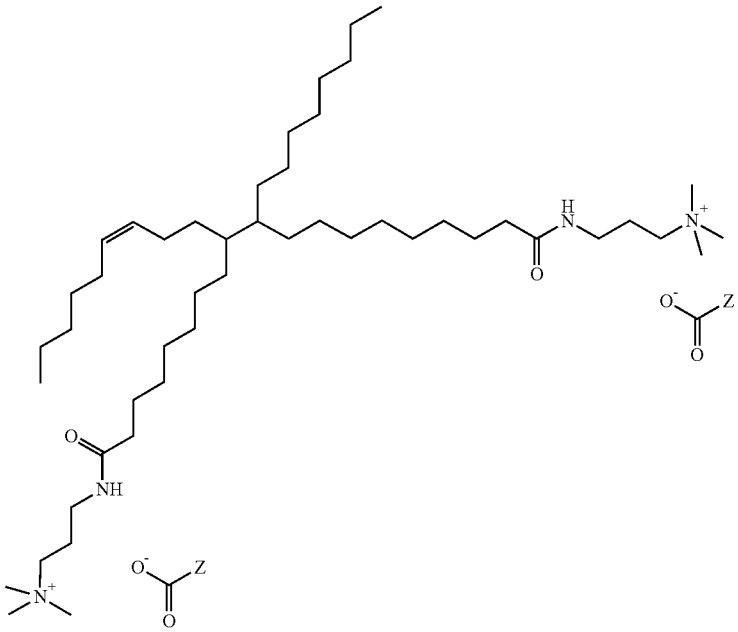

wherein Z represents a $C_1$-$C_{16}$, linear or branched, saturated or unsaturated, cyclic or acyclic, aliphatic or aromatic hydrocarbyl group optionally substituted by a functional group comprising an oxygen and/or a nitrogen atom.

According to an embodiment, Z in formula (Ib) is as defined above in relation to formula (II). According to a particular embodiment, Z in formula (Ib) is selected from a methyl group, a n-pentyl group, ortho-hydroxyphenyl, —$(CH_2)_{10-12}CH_3$ and heptadec-8-enyl, preferably from ortho-hydroxyphenyl and —$(CH_2)_{10-12}CH_3$, more preferably from —$(CH_2)_{10-12}CH_3$.

According to an embodiment, the compound of formula (I) is prepared by the following process:

Reacting a diacid of formula (III) with an amino amine of formula (IV) in order to provide an amidoamine compound of formula (V), for example according to the following scheme:

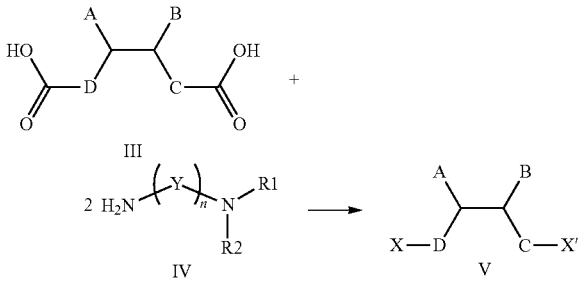

wherein X' represents the radical of formula (VI):

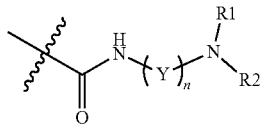

(VI)

followed by either Route A or Route B.

In the above formulas (III), (IV), (V) and (VI), A, B, C, D, Y, n, R1 and R2 have the same definition as in relation to formulas (I) and (II). It can be noted that if two different compounds of formula (IV) are used, we can obtain a formula (V) wherein X' are different. Preferably, a unique amino amine of formula (IV) is used and both X' in formula (V) are identical.

The diacid of formula (III) can be a dimerized oleic acid, tall oil fatty acid, linoleic acid, or mixtures of one or more of these unsaturated acids. These diacids are widely commercially available. The diacid can be derived from natural source, such as coconut, laurel, palm, palm kernel, cottonseed, olive, hemp, soybean, tall oil or tallow fats or oils. Coconut-based products are particularly preferred.

The amino amine of formula (IV) is preferably an amino alkylene amine. The amino amine of formula (IV) can be commercially available. Among suitable amino amines of formula (IV), mention may be made of dimethylaminopropylamine (DMAPA) or dimethylaminoethylamine (DMAEA).

The reaction between compounds of formula (III) and (IV) preferably takes place at a temperature ranging from 160 to 220° C. and a pressure ranging from 1 bar to 4 bars, preferably at atmospheric pressure (around 1 bar). According to a preferred embodiment, the reaction takes place using an inert gas, such as hydrogen, in the gas phase, until for example at least 85, 90 or 95% completion, typically for 30 minutes to 16 hours. Preferably the molar ratio between the diacid compound and the amino acid compound ranges from 1:1 to 1:4. According to an embodiment, the molar ratio between acid groups and primary amine groups during the reaction ranges from 1:1 to 1:1.1, 1:1.2 or 1:1.25.

The reaction can be performed in the presence of a catalyst in order to influence speed and selectivity. However, according to an embodiment, no additional catalyst is used in order to avoid purification steps at a later stage. Either for route A or route B, a solvent is preferably used. Among suitable solvents, mention may be made of alcohols having from 1 to 14 carbon atoms, such as methanol or ethanol.

The Route A comprises reacting the amidoamine compound of formula (V) with a carboxyl compound of formula (Vila) in order to provide the compound of formula (I), for example according to the following scheme:

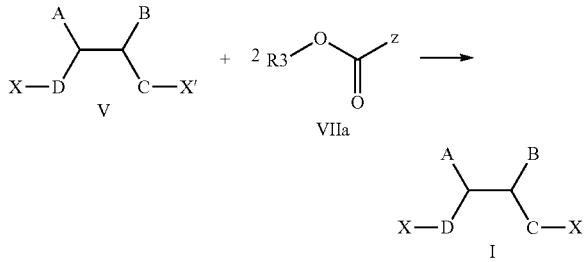

If Z group is an aryl compound, route A may be preferred since the reactivity of the corresponding compound of formula (Vila) allows to efficiently quaternize the compound of formula (V). According to an embodiment illustrating route A, the compound of formula (VII) can be methyl salicylate.

The Route B comprises (b1) reacting the amidoamine compound of formula (V) with a dialkyl carbonate compound of formula (VIII) in order to provide a quaternary ammonium compound of formula (IX), for example according to the following scheme:

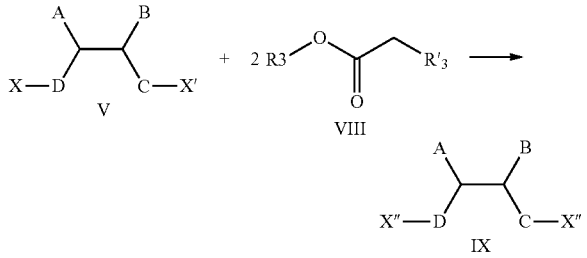

wherein

X" represents the radical of formula (X):

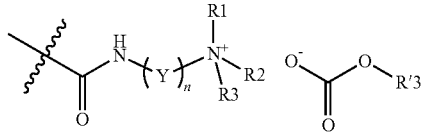

(X)

followed by (b2) reacting the quaternary ammonium compound of formula (IX) with a carboxyl compound of formula (VII) in order to provide the compound of formula (I), for example according to the following scheme:

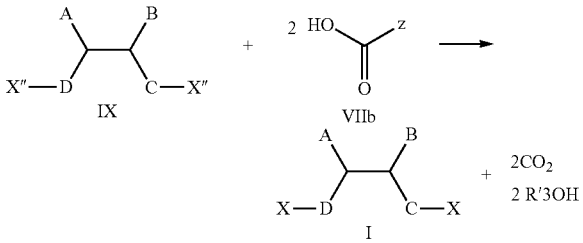

In the above formulas (Vila), (VIIb), (VIII), (IX) and (X), A, B, C, D, Y, n, R1, R2, R3, Z have the same meaning as in formulas (I) and (II). R'3 represents an alkyl group having preferably from 1 to 6 carbon atoms, Route B is a two-steps process that can be preferred when the reactivity between the compounds of formula (V) and (VIIb) is not sufficiently high to perform the quaternization. As an example, if the compound of formula (VIIb) is an ester of fatty acid having more than 4 carbon atoms, this kind of ester has a low reactivity in order to quaternize the compound of formula (V) and route B may be preferred to obtain the compound of formula (I). According to an embodiment, the compound of formula (VIII) is dimethylcarbonate or diethylcarbonate, preferably dimethylcarbonate.

Preferably, the molar ratio, for reaction (b1), between the dialkyl carbonate compound of formula (VIII) and the amidoamine compound of formula (V) ranges from 2, 2.5, 3, 3.5, or 4 to 1. According to an embodiment, the molar ratio between carbonate groups and tertiary amine groups during the quaternizing reaction ranges from 1, 1.25, 1.5, 1.75, or 2 to 1. According to an embodiment, the molar ratio between carbonate groups and tertiary amine groups during the quaternizing reaction ranges from 1.5-2 to 1.

Preferably, for reaction (b1), the temperature ranges from 80 to 140° C. and the pressure ranges from 1 to 6 bars. The time reaction (b1) can ranges from 4 to 24 hours. As an example, a temperature of 110° C., a pressure of 3.5 bar and a time reaction of 8 hours can be suitably used. Residual amounts of compounds of formula (VIII) and solvent can be removed with vacuum and/or nitrogen stripping, and optionally recycled for re-use in the reaction step (b1), after an optional purification.

The compound of formula (VIIb) is preferably selected from fatty acids, more preferably from saturated linear fatty acids with on average from 8, 10 or 12 carbon atoms up to 24, 20, 18, 16 or 14 carbon atoms. Preferably, at least 50% by weight, preferably at least 70% by weight, more preferably at least 90% by weight, of the compounds of formula (VIIb) are fatty acids having from 11 to 15 carbon atoms, preferably from 12 to 14 carbon atoms. Among suitable compounds of formula (VIIb), mention may be made of commercially available product "mid-cut coco". As an example, a mixture of lauric acid, myristic acid and palmitic acid ex Pacific Oleochemicals Sdn. Bhd as well as Kortacid® 1299/1499/1698 ex Sigma Aldrich can be used.

Preferably, for reaction (b2), the temperature ranges from 60 to 120° C., the pressure is the atmospheric pressure and the time reaction ranges from 0.5 to 2 hours. Typically, for reaction (b2), 1 or 1.1 up to 2, 1.75, 1.5, or 1.25 moles of carboxyl compounds of formula (VIIb) are used per mole of anion on the quaternary ammonium compound of formula (IX).

In the reaction (b2), the reaction can be forced to completion by removal of CO2 and/or the solvent used and formed, e.g. methanol if DMC and ethanol if DEC is used as the quaternizing agent. The recovered solvent can be recycled to the quaternization reaction (b1). Since typically (m)ethanol is being formed in the anion replacement reaction (b2), typically not all (m)ethanol can be recycled. Residual amounts of CO2 and alcohols R30H (such as methanol or ethanol depending on the carbonate used) can be removed under vacuum or by nitrogen stripping, suitably at temperatures of from 60 to 140° C. at a pressure which is lowered from atmospheric pressure to less than 5 mbar.

The fuel composition may comprise mono-quaternized compound(s), i.e. compounds comprising only one quaternary ammonium function. As an example, the mono-quaternized compound(s) can be represented by the following formula (XI):

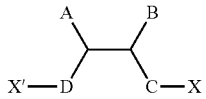

(XI)

wherein A, B, C, X and X' have the definitions given above. Obviously, the quaternized radical X can be linked either to the C radical or to the D radical and conversely, the non-quaternized radical X' can be linked either to the D radical or to the C radical.

The compound of formula (XI) can be obtained during the quaternization step which can lead to bis-quaternized compounds of formula (I) but also to mono-quaternized compounds of formula (XI). According to a preferred embodiment, mono-quaternized compound(s) represent less than 5% by weight of the total weight of the fuel composition.

The fuel composition may also comprise tri-quaternized compound(s), i.e. compounds comprising three quaternary ammonium functions. If we refer to formula (I) of the invention, tri-quaternized compounds may reply to formula (I) but wherein A or B are further substituted by a X radical as defined above. Tri-quaternized compounds may be obtained, in addition to compounds of formula (I) of the invention, if reactants of diacid type (see formula (III) above) also comprise triacid compounds.

According to a preferred embodiment, tri-quaternized compound(s) represent less than 5% by weight of the total weight of the fuel composition. According to a preferred embodiment, the number of quaternized amine functions is comprised between 65% (included) and 100%, preferably between 70% (included) and 100%, preferably between 75% (included) and 100%, preferably between 80% (included) and 100%, preferably between 90% (included) and 100%, preferably between 95% (included) and 100%, based on the total number of quaternizable amine functions. According to an embodiment of the invention, the fuel composition comprises at least 5 ppm, preferably from 5 to 10000 ppm by weight, more preferably from 10 to 5000 ppm by weight, even more preferably from 15 to 1000 ppm by weight, still more preferably from 20 to 500 ppm by weight, of compound(s) of formula (I).

The liquid fuel is advantageously derived from one or more sources selected from mineral, animal, plant and synthetic sources. Oil will preferably by chosen as mineral source. The liquid fuel is preferably chosen from hydrocarbon-based fuels and fuels that are not essentially hydrocarbon-based, alone or as a mixture.

The term "hydrocarbon-based fuel" means a fuel constituted of one or more compounds constituted solely of carbon and hydrogen. The term "fuel not essentially hydrocarbon-based" means a fuel constituted of one or more compounds not essentially constituted of carbon and hydrogen, i.e. which also contain other atoms, in particular oxygen atoms.

The hydrocarbon-based fuels especially comprise middle distillates with a boiling point ranging from 100 to 500° C. or lighter distillates with a boiling point in the gasoline range. These distillates may be chosen, for example, from the distillates obtained by direct distillation of crude hydrocarbons, vacuum distillates, hydrotreated distillates, distillates derived from the catalytic cracking and/or hydrocracking of vacuum distillates, distillates resulting from conversion processes such as ARDS (atmospheric residue desulfurization) and/or viscoreduction, and distillates derived from the upgrading of Fischer-Tropsch fractions. The hydrocarbon-based fuels are typically gasolines and diesel fuels.

According to an embodiment, the liquid fuel is selected from diesel fuels and gasoline fuels. The gasolines in particular comprise any commercially available fuel composition for spark ignition engines. A representative example that may be mentioned is the gasolines corresponding to standard NF EN 228. Gasolines generally have high octane numbers (MON or RON) to avoid knock. Typically, the fuels of gasoline type sold in Europe, in accordance with standard NF EN 228, have a motor octane number (MON) of greater than 85 and a research octane number (RON) of at least 95. Fuels of gasoline type generally have an RON ranging from 90 to 100 and an MON ranging from 80 to 90, the RON and MON being measured according to standard ASTM D 2699-86 or D 2700-86.

Diesel fuels in particular comprise all commercially available fuel compositions for diesel engines. A representative example that may be mentioned is the diesel fuels corresponding to standard NF EN 590.

Fuels that are not essentially hydrocarbon-based especially comprise oxygen-based compounds, for example distillates resulting from the BTL (biomass to liquid) conversion of plant and/or animal biomass, taken alone or in combination; biofuels, for example plant and/or animal oils and/or ester oils; biodiesels of animal and/or plant origin and bioethanols. The mixtures of hydrocarbon-based fuel and of fuel that is not essentially hydrocarbon-based are typically diesel fuels of Bx type or gasolines of Ex type.

The term "diesel fuel of Bx type for diesel engines" means a diesel fuel which contains x % (v/v) of plant or animal ester oils (including spent cooking oils) transformed via a chemical process known as transesterification, obtained by reacting this oil with an alcohol so as to obtain fatty acid esters (FAE). With methanol and ethanol, fatty acid methyl esters (FAME) and fatty acid ethyl esters (FAEE) are obtained, respectively. The letter "B" followed by a number indicates the percentage of FAE contained in the diesel fuel. Thus, a B99 contains 99% of FAE and 1% of middle distillates of fossil origin (mineral source), B20 contains 20% of FAE and 80% of middle distillates of fossil origin, etc. Diesel fuels of Bo type which do not contain any oxygen-based compounds are thus distinguished from diesel fuels of Bx type which contain x % (v/v) of plant oil esters or of fatty acid esters, usually the methyl esters (POME or FAME). When the FAE is used alone in engines, the fuel is designated by the term B100. The term "gasoline of Ex type for spark ignition engines" means a gasoline fuel which contains x % (v/v) of oxygen-based compounds, generally ethanol, bioethanol and/or tert-butyl ethyl ether (TBEE).

The sulfur content of the liquid fuel is preferably less than or equal to 5000 ppm by weight, preferably less than or equal to 500 ppm by weight and more preferentially less than or equal to 50 ppm by weight, or even less than 10 ppm by weight and advantageously sulfur-free. Besides the compound of formula (I) described above, the fuel composition may also comprise one or more other additives different from the compounds of formula (I), chosen from the other known fuel additives, for example from anticorrosion agents, antioxydants, solvents, carrier oils, tracers, dispersants, de-emulsifiers, antifoams, biocides, reodorants, procetane additives, friction modifiers, lubricant additives or oiliness additives, combustion promoters (catalytic combustion and soot promoters), agents for improving the cloud point, the pour point or the cold-flow plugging point (CFPP), anti-sedimentation agents (WASA wax anti-settling agents), antiwear agents and/or conductivity modifiers.

Among these additives, mention may be made in particular of:

a) procetane additives, especially (but not limitatively) chosen from alkyl nitrates, preferably 2-ethylhexyl nitrate, aryl peroxides, preferably benzyl peroxide, and alkyl peroxides, preferably tert-butyl peroxide;

b) antifoam additives, especially (but not limitatively) chosen from polysiloxanes, oxyalkylated polysiloxanes and fatty acid amides derived from plant or animal oils. Examples of such additives are given in EP861882, EP663000 and EP736590;

c) cold flow improvers (CFI) chosen from copolymers of ethylene and of an unsaturated ester, such as ethylene/vinyl acetate (EVA), ethylene/vinyl propionate (EVP), ethylene/vinyl ethanoate (EVE), ethylene/methyl methacrylate (EMMA) and ethylene/alkyl fumarate copolymers described, for example, in U.S. Pat. Nos. 3,048,479, 3,627,838, 3,790,359, 3,961,961 and EP261957;

d) lubricant additives or anti-wear agents, especially (but not limitatively) chosen from the group constituted by fatty acids and ester or am ide derivatives thereof, especially glyceryl monooleate, and monocyclic and polycyclic carboxylic acid derivatives; Examples of such additives are given in the following documents: EP680506, EP860494, WO98/04656, EP915944, FR2772783, FR2772784;

e) cloud point additives, especially (but not limitatively) chosen from the group constituted by long-chain olefin/(meth)acrylic ester/maleimide terpolymers, and fumaric/maleic acid ester polymers. Examples of such additives are given in FR2528051, FR2528051, FR2528423, EP112195, EP172758, EP271385 and EP291367;

f) detergent additives, especially (but not limitatively) chosen from the group constituted by succinimides, polyetheramines and quaternary ammonium salts other than compounds of formula (I); for example those described in U.S. Pat. No. 4,171,959 and WO2006135881;

g) cold workability polyfunctional additives chosen from the group constituted by polymers based on olefin and alkenyl nitrate as described in EP573490.

These other additives are generally added in the fuel composition an amount ranging from 0.5 to 1000 ppm by weight (each), more preferably ranging from 1-500 ppm by weight (each), more preferably ranging from 1-400 ppm by weight (each), even more preferably ranging from 1-20 ppm by weight (each).

In particular embodiments of the present invention, the specific combinations of the compound of formula (I)

described above and other additives different from the compounds of formula (I) can be:

h) compound of formula (I) described above and one or more other ammonium quaternary salt(s), especially a PIBSI-quaternary ammonium salt (polyisobutylene succinimide-quaternary ammonium salt, a PIBSI quaternized by an ammonium), obtained for example by reacting PIBSA with a polyamine and a quaternizing agent, i) compound of formula (I) described above and any Mannich base, especially a PIB-Mannich (polyisobutylene succinimide) base, or especially a phenol Mannich base, obtained for example by reacting a phenol with a polyamine, j) compound of formula (I) described above and any PIBSI compound (for example obtained by reacting a PIBSA with a polyamine), k) compound of formula (I) described above, Mannich base, and any PIBSI compound, the Mannich base being preferably a PIB-Mannich (polyisobutylene succinimide) base or a phenol Mannich base, obtained for example by reacting a phenol with a polyamine, l) compound of formula (I) described above and any PIBSI compound and one or more other ammonium quaternary salt(s), especially PIBSI-quaternary ammonium salt(s), m) compound of formula (I) described above and any polyetheramine, n) compound of formula (I) described above and any PIBA (polyisobutylene amine), o) compound of formula (I) described above and any betaine, especially alkylamidoamine betaine, especially alkylamidoamine betain with fatty chain, the fatty chain typically comprising from 8 to 30 carbon atoms, p) compound of formula (I) described above and one or more other ammonium quaternary salt(s), especially a PIBSI-quaternary ammonium salt (PIBSI-AQ) and any betaine, especially alkylamidoamine betaine, especially alkylamidoamine betain with fatty chain, the fatty chain typically comprising from 8 to 30 carbon atoms.

In specific embodiments of the present invention, a combination selected from combinations h), i), j), k), l) m), and n) is used in gasoline compositions, i.e. with a liquid fuel which is a gasoline fuel. In specific embodiments of the present invention, a combination selected from combinations h), o) and p) is used in diesel compositions, i.e. with a liquid fuel which is a diesel fuel. In specific embodiments of the present invention, the option o), used in a diesel composition, comprised a quantity of around 120-130 ppm by weight of the betain compound, and around 10-30 ppm by weight, more especially around 20-25 ppm by weight of compound of formula (I) according to the composition of diesel. In specific embodiments of the present invention, the option p), used in a diesel composition, comprised a quantity of around 120-130 ppm by weight of PIBSI-AQ and around 120-130 ppm by weight of the betain compound, and around 10-30 ppm by weight, more especially around 20-25 ppm by weight of compound of formula (I) according to the composition of diesel.

In a particular embodiment of option o), the compound of formula (I) is in a molar excess with respect to the betain compound or the betain compound is in a molar excess with respect to the compound of formula (I). According to an embodiment, the molar ratio between the compound of formula (I) and the betain compound ranges from 1.15, 1.25, 1.5, 1.75, or 2 to 2.5 or from 0.15, 0.2, 0.25, 0.3, 0.4, or 0.5 to 0.9. According to an embodiment, the molar ratio between the compound of formula (I) and the betain compound ranges from 1.75 to 2.25 or from 0.3 to 0.7.

According to a particular embodiment, the fuel composition is prepared according to any known process by supplementing the liquid fuel described previously with at least one compound of formula (I) as described above. Another object of the present invention is the use of the compound of formula (I) defined above as a detergent additive in a liquid fuel, preferably for combustion engine, even more preferably for internal combustion engine, including diesel internal combustion engine and gasoline internal combustion engine.

The term "detergent additive for liquid fuel" means an additive which is incorporated in small amount into the liquid fuel and produces an effect on the cleanliness of said motor when compared with said liquid fuel not specially supplemented. By "small amount", it can be understood an amount as small as 5 ppm by weight, and up to 10000 ppm by weight.

According to a particular embodiment, the use of the compound of formula (I) as described previously in the liquid fuel makes it possible to maintain the cleanliness of at least one of the internal parts of the engine and/or to clean at least one of the internal parts of the engine, the engine being preferably a combustion engine and more preferably an internal combustion engine. The use of the compound of formula (I) in the liquid fuel makes it possible in particular to limit or prevent the formation of deposits in at least one of the internal parts of said engine ("keep-clean" effect) and/or to reduce the existing deposits in at least one of the internal parts of said engine ("clean-up" effect). Thus, the use of the compound of formula (I) in the liquid fuel makes it possible, when compared with liquid fuel that is not specially supplemented with additive, to limit or prevent the formation of deposits in at least one of the internal parts of said engine or to reduce the existing deposits in at least one of the internal parts of said engine.

Advantageously, the use of the compound of formula (I) in the liquid fuel makes it possible to observe both effects simultaneously, limitation (or prevention) and reduction of deposits ("keep-clean" and "clean-up" effects). The deposits are distinguished as a function of the type of internal combustion engine and of the location of the deposits in the internal parts of said engine.

According to a particular embodiment, the internal combustion engine is a spark ignition engine, preferably with direct injection (DISI: direct-injection spark ignition engine). The deposits targeted are located in at least one of the internal parts of said spark ignition engine. The internal part of the spark ignition engine kept clean and/or cleaned up is advantageously chosen from the engine intake system, in particular the combustion chamber (CCD: combustion chamber deposit, or TCD: total chamber deposit) and the fuel injection system, in particular the injectors of an indirect injection system (PFI: port fuel injector) or the injectors of a direct injection system (DIS 1).

According to a particular embodiment, the use of the compound of formula (I) in the liquid fuel makes it possible, when compared with liquid fuel that is not specially supplemented with additive, to limit or prevent the valve sticking phenomenon, in particular to reduce the deposits on the intake valve stems. According to another particular embodiment, the internal combustion engine is a diesel engine, preferably a direct-injection diesel engine or an indirect-injection diesel engine in particular a diesel engine with a common-rail injection system (CRDI: common-rail direct injection). The deposits targeted are located in at least one of the internal parts of said diesel engine.

According to another particular embodiment, the internal combustion engine is a gasoline engine, which can be a direct-injection gasoline engine or an in direct-injection gasoline engine. Advantageously, the deposits targeted are located in the injection system of the diesel engine, preferably located on an external part of an injector of said injection system, for example the fuel spray tip and/or on an internal part of an injector of said injection system (IDID: internal diesel injector deposits), for example on the surface of an injector needle. The deposits may be constituted of coking-related deposits and/or deposits of soap and/or lacquering type.

The compound of formula (I) as described previously may advantageously be used in the liquid fuel to reduce and/or prevent power loss due to the formation of deposits in the internal parts of a direct-injection diesel engine, said power loss being determined according to the standardized engine test method CEC F-98-08. The compound of formula (I) as described previously may advantageously be used in the liquid fuel to reduce and/or prevent restriction of the fuel flow emitted by the injector of a direct-injection diesel engine during its functioning, said flow restriction being determined according to the standardized engine test method CEC F-23-1-01. Advantageously, the use of the compound of formula (I) as described above makes it possible, when compared with liquid fuel that is not specially supplemented, to limit or prevent the formation of deposits on at least one type of deposit described previously and/or to reduce the existing deposits on at least one type of deposit described previously.

According to a particular embodiment, the use of the compound of formula (I) described above also makes it possible to reduce the fuel consumption of an internal combustion engine. According to another particular embodiment, the use of the compound of formula (I) described above also makes it possible to reduce the pollutant emissions, in particular the particle emissions of an internal combustion engine. Advantageously, the use of the compound of formula (I) makes it possible to reduce both the fuel consumption and the pollutant emissions. Among pollutant emissions, mention may be made of nitrogen oxides (NOx), sulphurized oxides (SOx), hydrocarbons, carbon oxides (Cox) and particles.

The compound of formula (I) described above may be used alone, in the form of a mixture of at least two of said compounds of formula (I) or in the form of a concentrate. The compound of formula (I) may be added to the liquid fuel in a refinery and/or may be incorporated downstream of the refinery and/or optionally as a mixture with other additives in the form of an additive concentrate, also known by the common name "additive package". The compound of formula (I) described above is typically used as a mixture with an organic liquid in the form of a concentrate.

According to a particular embodiment, a fuel concentrate comprises one or more compounds of formula (I) as described above, as a mixture with an organic liquid. The organic liquid is inert with respect to the compound of formula (I) described above and miscible in the liquid fuel described previously. The term "miscible" describes the fact that the compound of formula (I) and the organic liquid form a solution or a dispersion so as to facilitate the mixing of the compound of formula (I) in the liquid fuels according to the standard fuel supplementation processes. The organic liquid is advantageously chosen from aromatic hydrocarbon-based solvents such as the solvent sold under the name Solvesso, alcohols, ethers and other oxygen-based compounds and paraffinic solvents such as hexane, pentane or isoparaffins, alone or as a mixture.

The concentrate may advantageously comprise from 5% to 99% by weight, preferably from 10% to 80% by weight and more preferentially from 25% to 70% by weight of compound(s) of formula (I) as described previously. The concentrate may typically comprise from 1% to 95% by weight, preferably from 10% to 70% by weight and more preferentially from 25% to 60% by weight of organic liquid, the remainder corresponding to the compound(s) of formula (I).

According to a particular embodiment, the compound of formula (I) is used in the form of an additive concentrate in combination with at least one other fuel additive for an internal combustion engine other than the compound(s) of formula (I) described previously. The additive concentrate may typically comprise one or more other additives selected from additives other than the compounds of formula (I) described above, for example from anticorrosion agents, dispersants, de-emulsifiers, antifoams, biocides, reodorants, procetane additives, friction modifiers, lubricant additives or oiliness additives, combustion promoters (catalytic combustion and soot promoters), agents for improving the cloud point, the pour point or the cold-flow plugging point (CFPP), anti-sedimentation agents, anti-wear agents and conductivity modifiers. The additives may be those listed above in relation to the fuel composition.

These other additives are generally added in the concentrate in an amount ranging from 0.1 to 95% by weight (each), more preferably ranging from 0.2 to 80%, even more preferably ranging from 0.3 to 70%, based on the total weight of the concentrate.

According to a particular embodiment, a process for maintaining the cleanliness (keep-clean) and/or for cleaning (clean-up) at least one of the internal parts of an engine comprises the preparation of a fuel composition by supplementation of a fuel with one or more compound(s) of formula (I) as described above and combustion of said fuel composition in the internal combustion engine. The representative characteristic of the detergency properties of the fuel will depend on the type of internal combustion engine, for example a diesel or spark ignition engine, the direct or indirect injection system and the location in the engine of the deposits targeted for cleaning and/or maintaining the cleanliness. For direct-injection diesel engines, the detergency properties of the fuel may be assessed, for example, by the power loss due to the formation of deposits in the injectors or by the restriction of the fuel flow emitted by the injector during the functioning of said engine. The detergency properties may also be assessed by the appearance of lacquering-type deposits on the injector needle (IDID).

Methods for evaluating the detergency properties of fuels have been widely described in the literature and fall within the general knowledge of a person skilled in the art. Non-limiting examples that will be mentioned include the tests standardized or acknowledged by the profession or the following methods described in the literature: For direct-injection diesel engines:

- the method DW10, standardized engine test method CEC F-98-08, for measuring the power loss of direct-injection diesel engines,
- the method XUD9, standardized engine test method CEC F-23-01 for measuring the restriction of fuel flow emitted by the injector, For indirect-injection spark ignition engines:

- the inlet valve sticking tendency of gasoline fuels (VW Waterboxer Gasoline Engine), standardized test method CEC F-16-96,
- the Mercedes Benz M102E method, standardized test method CEC F-05-93, and
- the Mercedes Benz M111 method, standardized test method CEC F-20-98.

These methods make it possible to measure the intake valve deposits (IVD), the tests generally being performed on a Eurosuper gasoline corresponding to standard EN228. For direct-injection spark ignition (DISI) engines:

the method described by the Applicant in the article "Evaluating Injector Fouling in Direct Injection Spark Ignition Engines", Mathieu Arondel, Philippe China, Julien Gueit; Conventional and future energy for automobiles; 10th international colloquium; Jan. 20-22, 2015, pages 375-386 (Technische Akademie Esslingen par Techn. Akad. Esslingen, Ostfildern) and in the SAE Technical Paper 2017-01-2294, "Injector Fouling in Direct Injection Spark Ignition Engines—A New Test Procedure for the Evaluation of Gasoline Additives", Julien Gueit, Jérôme Obiols; International powertrains, Fuels & Lubricants Meeting; Oct. 16-19, 2017 (Beijing), for the evaluation of the coking deposits on the injector, this method being cited by way of example and/or incorporated by reference into the present patent application.

the new DISI Injector fouling test in the process of being proposed to CEC, standardized test method TDG-F-113, by using a widespread used version of the EA111 engine developed by Volkswagen AG. The measured variable for this test is the injection time (duration).

According to an embodiment of the invention, the compound of formula (I) is used in combination with at least one quaternary ammonium compound different from compounds of formula (I), such as polyisobutylene succinimide quaternary ammonium salts, and at least one betaine, such as alkylamidoamine betaine, in a diesel composition in order to reduce the power loss in diesel engines. According to an embodiment of the invention, the compound of formula (I) is used in combination with at least one Mannich base, such as a phenol Mannich base, and at least one polyisobutylene succinimide compound, in a gasoline composition in order to reduce the power loss in gasoline engines.

According to an embodiment of the invention, the compound of formula (I) is used in combination with at least one polyisobutylene succinimide compound, in a gasoline composition in order to reduce the power loss in gasoline engines. The inventors surprisingly found that both compounds synergistically reduce the power loss in gasoline engines. According to an embodiment of the invention, the compound of formula (I) is used in combination with at least one betaine, such as alkylamidoamine betaine, in a diesel composition in order to reduce the power loss in diesel engines.

Another object of the present invention relates to the use of the compound of formula (I) as defined previously as a demulsifying additive in a liquid fuel. More particularly, the compound of formula (I) as defined previously can be used to separate water and liquid fuel, when said liquid fuel contains water. The specific embodiments defined above in relation to the compound of formula (I) and to the liquid fuel also apply to the use of the compound of formula (I) as a demulsifying additive in a liquid fuel.

Another object of the present invention relates to the use of the compound of formula (I) as defined previously as a lubricity additive in a liquid fuel. More particularly, the compound of formula (I) as defined previously can be used to improve lubricity of liquid fuel, in particular in gasoline fuel. The specific embodiments defined above in relation to the compound of formula (I) and to the liquid fuel also apply to the use of the compound of formula (I) as a lubricity additive in a liquid fuel.

Another object of the present invention relates to the use of the compound of formula (I) as defined previously as a corrosion inhibitor additive in a liquid fuel. More particularly, the compound of formula (I) as defined previously can be used to prevent surface corrosion of metallic components throughout the fuel storage and the delivery systems, when liquid fuel contains water. The specific embodiments defined above in relation to the compound of formula (I) and to the liquid fuel also apply to the use of the compound of formula (I) as a corrosion inhibitor in a liquid fuel.

Another object of the present invention relates to the use of the compound of formula (I) as defined previously as an antioxidant additive and/or stability improver in a liquid fuel. More particularly, the compound of formula (I) as defined previously can be used to enhance fuel stability and inhibit its tendency to deteriorate in storage. The specific embodiments defined above in relation to the compound of formula (I) and to the liquid fuel also apply to the use of the compound of formula (I) as an antioxidant additive and/or stability improver in a liquid fuel.

Another object of the present invention relates to the use of the compound of formula (I) as defined previously as a conductivity improver in a liquid fuel. More particularly, the compound of formula (I) as defined previously can be used to greatly enhance the conductivity of the blended fuel so that static charge accumulation cannot readily occur and charge dissipation rates are increased, thus preventing static discharge which could lead to an obvious fire hazard.

The specific embodiments defined above in relation to the compound of formula (I) and to the liquid fuel also apply to the use of the compound of formula (I) as a conductivity improver in a liquid fuel. Another object of the present invention relates to the use of the compound of formula (I) as defined previously as a metal deactivator in a liquid fuel containing soluble metal salts, know to promote instability in the fuel by catalysing the oxidation reactions. More particularly, the compound of formula (I) as defined previously can be used to react with dissolved metal in the fuel to form stable chelate in which the metal has no pro-oxidant effect.

The specific embodiments defined above in relation to the compound of formula (I) and to the liquid fuel also apply to the use of the compound of formula (I) as a metal deactivator in a liquid fuel. Another object of the present invention relates to the use of the compound of formula (I) in the oilfield industry, e.g. in oil well drilling operations or oil production operations.

The present invention also describes the following items, which are an embodiment of the present invention:

1. Quaternary amidoamine obtainable by reacting one or more multifunctional acids with on average from 1.1 to 6.0 acid groups, with an amino amine of formula E2).

$$(alkyl)_2N\text{-}(alkylene\text{-}NX)_nH \quad E2)$$

wherein each alkyl independently is selected from methyl, ethyl, propyl, and butyl, wherein each alkylene independently is selected from methylene, ethylene, propylene or (iso)butylene, and each X, independently, is H or C1-4 alkyl and n is 1, 2, 3, 4, 5, or 6, whereby preferably reaction conditions are chosen such that at least 90% of the acid groups of the multifunctional acid and preferably at least 90% of the NXH groups have reacted, followed by quaternization with a quaternizing agent and subsequent reaction with one or more fatty acids or esters to exchange the anion of the quaternizing agent by the anion of said fatty acids or esters.

2. Quaternary fatty amidoamine of item 1 wherein the one or more multifunctional acids comprise from 8 to 24 carbon atoms per acid function.
3. Quaternary fatty amidoamine of item 1 or 2 wherein the multifunctional acid is a dimerized fatty acid derived from oleic acid, tall oil fatty acid, linoleic acid, or mixtures thereof.
4. Quaternary fatty amidoamine of item 1, 2, or 3, wherein the amino amine is one or more compounds of the formula $(alkyl)_2N\text{-}(alkylene\text{-}NX)_nH$, wherein n is 1-6, each alkyl, independently, is methyl, ethyl, propyl, or butyl, alkylene is methylene, ethylene, propylene or (iso)butylene, and each X, independently is H or alkyl, whereby X preferably is H, alkylene preferably is ethylene or propylene, and preferably at least one alkyl is methyl.
5. Quaternary fatty amidoamine of any one of the previous items wherein the one or more fatty acids, or esters thereof, are selected from C1-24 linear or branched, saturated or unsaturated, fatty acids, aromatic acids, dimer fatty acid, which can be carboxylic or P or S based, mixtures thereof, or their derivatives, such as anhydrides, acid chlorides, and esters of said fatty acids or esters, which are preferably saturated.
6. Quaternary fatty amidoamine of item 5 wherein the fatty acids or esters thereof, are selected from carboxylic acids, which are preferably saturated or their derivatives, such as anhydrides, acid chlorides, and esters of said fatty acids.
7. Quaternary fatty amidoamine of any one of items 5-6 wherein the fatty acids, or esters thereof, are non-substituted.
8. Quaternary fatty amidoamine of any one of items 5-7 wherein the fatty acids, or esters thereof, comprise, on average, from 8 to 24 carbon atoms.
9. Quaternary fatty amidoamine of any one of the previous items of which the anion of the fatty acid is fully saturated.
10. Quaternary amidoamine according to item 9, wherein the whole molecule is fully saturated.
11. Quaternary amidoamine according to any one of the previous items, wherein the reaction product is of the formula E1):

$$MFA\text{-}((NX\text{-}alkylene\text{-})_nN^+(alkyl)_2Y^-)_x \quad E1)$$

Wherein MFA is the residue of a multifunctional acid with the multifunctionality being defined by x, which is the average number of fatty acid residues of the multifunctional acid per molecule.

12. Quaternary amidoamine according to item 11, wherein x is, on average, 1.3-6.0, n is 1-6, each alkylene is, independently, methylene, ethylene, propylene, and/or (iso)butylene, each X, independently, is H or alkyl, each alkyl, independently, is methyl, ethyl, propyl, or butyl, and Y is an organic acid anion, which can be carboxylic or an anion of an organic acid with P or S atoms in the acid moiety.
13. Process to make the products of any one of the preceding items comprising the steps of Reacting a multifunctional acid with on average from 1.1 to 6.0 acid groups with an amino amine $(alkyl)_2N\text{-}(alkylene\text{-}NX)_nH$, wherein each alkyl independently is selected from methyl, ethyl, propyl, and butyl, wherein each alkylene independently is selected from methylene, ethylene, propylene or (iso)butylene, and each X, independently, is H or C1-4alkyl and n is 1, 2, 3, 4, 5, or 6, to form an amidoamine, whereby preferably reaction conditions are chosen such that at least 90% of the acid groups of the multifunctional acid and preferably at least 90% of the NXH groups have reacted, quaternization of the amidoamine with a quaternizing agent to form a quaternary ammonium compound with an anion of said quaternizing agent, and replacing said anion with the anion of a fatty acid by reaction of the quaternary compound with one or more fatty acids or esters thereof.

The quaternary amidoamine of items 1 to 12 is involved in the same manner as the compounds of formula (I) defined above in the first embodiment, in particular in a fuel composition or in the above-described uses. Therefore, the embodiments detailed in relation to the compounds of formula (I) apply mutatis mutandis to the quaternary amidoamine of items 1 to 12.

EXAMPLES

Example 1: Synthesis of Compounds of Formula (I)

The compounds of formula (I) that have been tested in the present examples can be obtained by the following process, performed in a batch reactor. First step: 1 mole (573 g.) of a dimer fatty acid (Pripol® 1013 from Croda GmbH) is reacted with 2.4 moles (245 g.) of dimethyl amino propyl amine (DMAPA) (commercially available from Sigma Aldrich). 1.4 g. of 50% $H_3PO_2$ is added as catalyst. The temperature is increased in 5 h. to 190° C. and maintained for 3 h. at atmospheric conditions. Excess DMAPA is removed at 190° C. and 20 mbar. The first step reaction can be illustrated by the scheme below:

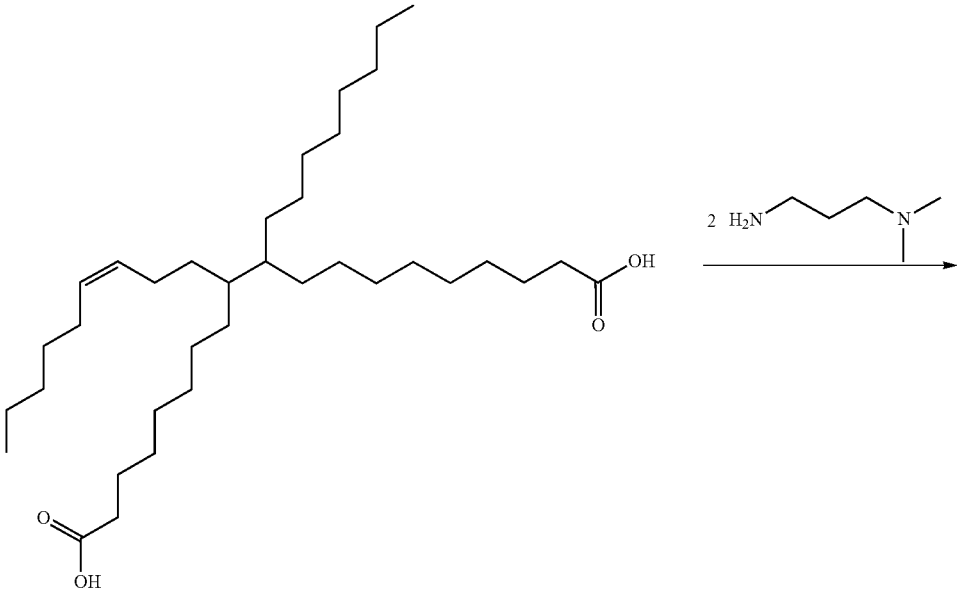
2 H2N
N
OH
O
O
OH
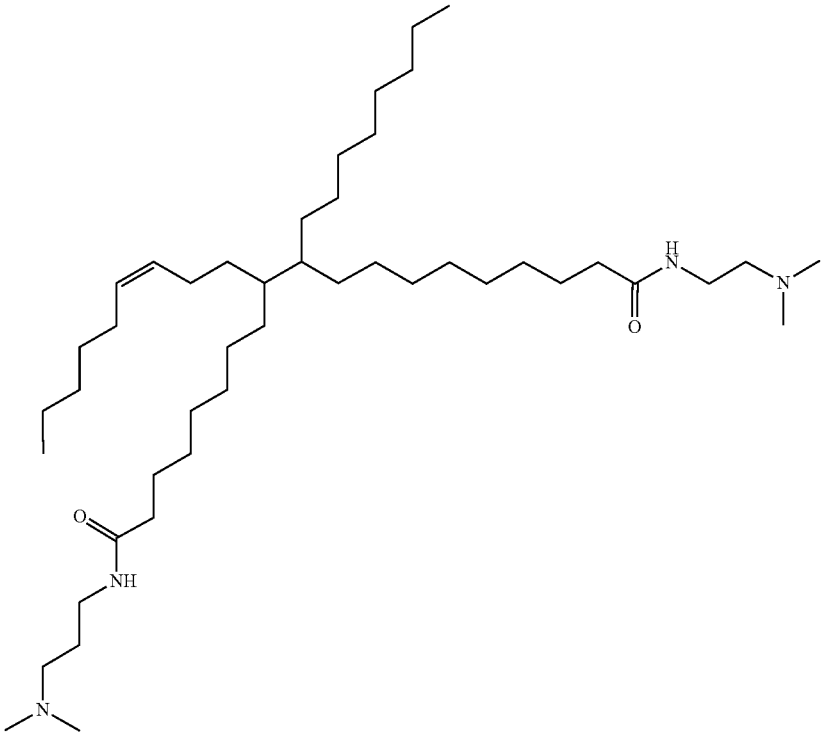
H
N
N
O
O
NH
N

Second step: 1 mole (730 g) of the amidoamine from the previous step is reacted with 4 moles of dimethylcarbonate (360 g.) (commercially available from Sigma Aldrich) in 360 g. of methanol. The reaction mixture is heated for 8 h. at 110° C. and 3.5 bar. The excess dimethyl carbonate and methanol are removed at 90° C. and 5 mbar. To prevent gelation some 225 g. (20%) of 2-ethyl-1-hexanol (commercially available from Sigma Aldrich) is added. The second step can be illustrated by the scheme below:

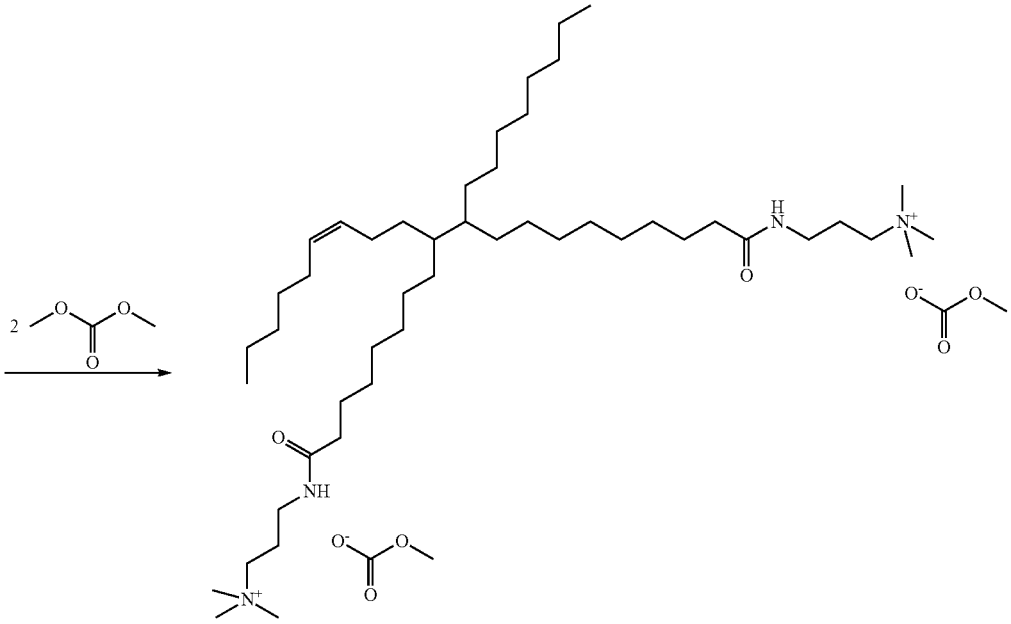

Third step: To 1 mole of the dimer amido quat (910 g in 225 g of 2-ethyl-1-hexanol) 2.2 moles (458 g when the mid-cut coco fatty acid is used) of an acid of formula ZCOOH is added at 90° C. and atmospheric pressure. Residual CO2 and methanol are removed at 90° C. and 5 mbar for 1 h. The third step reaction can be illustrated by the following scheme:

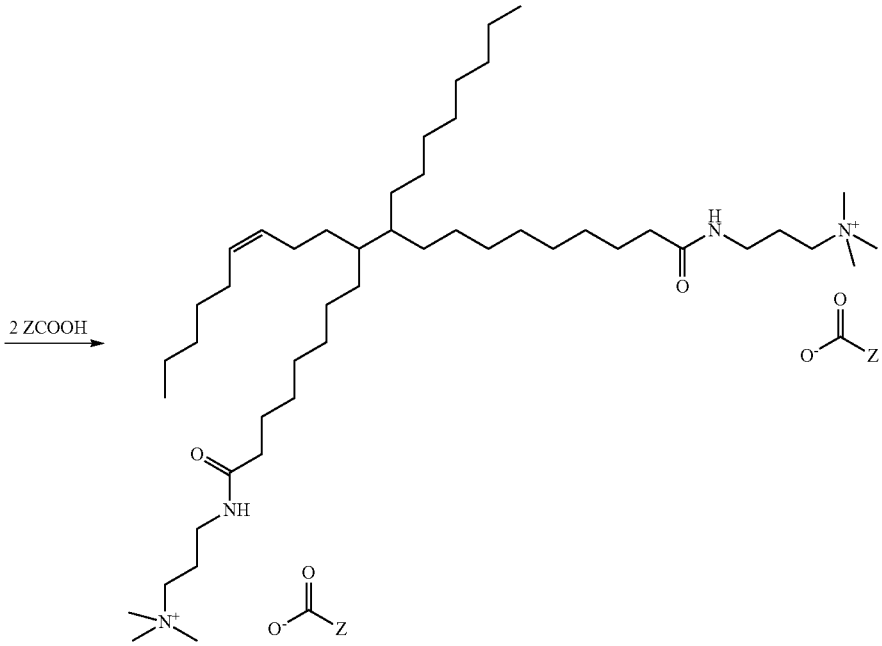

The following acids have been used:

acetic acid: Z is a methyl group=>DAQ-acetate, hexanoic acid: Z is a n-pentyl group=>DAQ-hexanoate, salicylic acid*: Z is a phenyl group substituted by a hydroxyl group=>DAQ-salicylate, mid-cut coco fatty acid (mixture of about 75% by weight of dodecanoic (lauric), about 25% by weight of tetradecanoic (myristic) and less than about 5% by weight of hexadecanoic (palmitic) acids): Z is a mixture of —$(CH_2)_{10}$ $CH_3$, —$(CH_2)_{12}CH_3$ and —$(CH_2)_{14}CH_3$ groups=>DAQ-mC.

*The compound of formula (I) wherein Z is a phenyl group substituted by a hydroxyl group has been prepared by a two-steps process according to Route A as defined above. In this process, salicylic acid is reacted directly with the amidoamine obtained at the end of the first step.

Example 2: Coking Injector Keep-Clean Performances in a Diesel Fuel

XUD9 Keep-Clean Test:

A set of samples is prepared and tested in the Peugeot XUD9 diesel fuel injector fouling test, designated CEC F-23-01. The Peugeot XUD9 engine is an indirect injection engine. In the test, the flow loss percent in the fuel injector is measured at the end of the test, with lower flow loss percent being desired, as indicative of reduced injector deposit formation.

The performances of the compounds of formula (I) have been compared to the performances of a detergent of the prior art: polyisobutene succinimide (PIBSI) such as those described in U.S. Pat. No. 3,172,892 or WO9812282.

The additive is added into the diesel fuel (Bo type) with a treat rate of 50 mg/kg of active material.

The results are indicated in table 1 below.

TABLE 1

XUD9 keep-clean tests results

| | Additive | Average flow loss |
|---|---|---|
| Reference | No additive | 70.0% |
| Comparative example A | PIBSI | 36.3% |
| Example 1 | DAQ-acetate | 7.7% |
| Example 2 | DAQ-hexanoate | 1.8% |
| Example 3 | DAQ-salicylate | 2.6% |
| Example 4 | DAQ-mC | 4.1% |

Examples 1 to 4 (with the additive of formula (I) defined in the invention) shows excellent performances in keep-clean performances, well better than the performances obtained with the PIBSI detergent of the prior art.

Example 3: Coking Injector Clean-Up Performances in a Diesel Fuel

XUD9 Clean-Up Test:

Different treat rates of additive have been tested in a diesel fuel (B7 type) for the additive DAQ-mC according to the invention and detailed in example 1 and for a quaternary ammonium derived from a PIBSI detergent as described in WO2006135881. The results are indicated in table 2 below.

TABLE 2

XUD9 clean-up tests results

| | Treat rate (mg/kg active material) | Average flow loss | Percent flow recovery |
|---|---|---|---|
| DAQ-mC | 100 | 2.2% | 96.7% |
| | 50 | 4.0% | 93.3% |
| | 25 | 16.5% | 73.1% |
| Quat. PIBSI | 100 | 4.5% | 93.8% |
| | 50 | 28.3% | 60.4% |
| | 25 | 56.0% | 19.4% |

The results of table 2 show that the compound of formula (I) according to the invention provides excellent clean-up performances of the injector coking phenomenon at any treat rate, and in particular at a treat rate of 50 mg/kg or even at a lower treat rate of 25 mg/kg of active material in the fuel. The performances obtained with the additive defined in the invention are much better than the performances obtained with the quaternary ammonium derived from a PIBSI of the prior art.

Example 4: Coking Injector Keep Clean Performances in a Gasoline Fuel with a Direct Injection System DISI (Direct Injection Spark Ignition Engine) Test:

The method described by the Applicant in the article "Evaluating Injector Fouling in Direct Injection Spark Ignition Engines", Mathieu Arondel, Philippe China, Julien Gueit; Conventional and future energy for automobiles; 10th international colloquium; Jan. 20-22, 2015, pages 375-386 (Technische Akademie Esslingen par Techn. Akad. Esslingen, Ostfildern) and in the SAE Technical Paper 2017-01-2294, "Injector Fouling in Direct Injection Spark Ignition Engines—A New Test Procedure for the Evaluation of Gasoline Additives", Julien Gueit, Jérôme Obiols; International powertrains, Fuels & Lubricants Meeting; Oct. 16-19, 2017 (Beijing), was used for the evaluation of the different samples for preventing coking injector deposits.

The method was developed on a modern downsized DISI (4 cylinders, 6-holes injectors, 150 bar of injection pressure, 1.2 L, 85 kW) engine representative of current production. The test cycle, repeated for 30 hours, uses high engine speeds at a low load operating point. The fouling is evaluated via the measurement of the change in mass of fuel per injection and comparing this result between the injector when new (before the test) and of the fouled injector at the end of the test, by using a hydraulic test bench.

Tests have been conducted on the "keep-clean" procedure to investigate the performance of the different samples. Different detergents have been compared at a treat rate of 100 mg/kg of active material in the CEC RF-83 gasoline: the DAQ-mC according to the invention and detailed in example 1, a quaternary ammonium derived from a PIBSI (Quat. PIBSI) as described in WO2006135881 and a commercially available polyisobutyleneamine (PIB-amine) from BASF. The results are indicated in table 3.

TABLE 3 keep clean results of the DISI test

| Detergents | Injector flow loss |
|---|---|
| None | 16.6% |
| Quat. PIBSI | 4.2% |

TABLE 3-continued

| keep clean results of the DISI test | |
|---|---|
| Detergents | Injector flow loss |
| PIB-amine | 9.5% |
| DAQ-mC | 1.8% |

The results of table 3 show that the compound of formula (I) according to the present invention provides excellent keep clean performances in a gasoline fuel, in particular better than the detergents of the prior art since it allows the minimum flow loss.

Example 5: Coking Injector Clean Up Performances in a Gasoline Fuel with a Direct Injection System VW EA111 Test:

This CEC test is being developed by Volkswagen. The proposed test addresses injector deposits in direct injection spark ignited engines (DISI) and the deposit control ability of gasoline, so that it can be used to evaluate DISI-DCA (Deposit Control Additives) performance of gasoline.

The test engine is the VW EA1111.4 L TSI (CAVE) engine with 132 kW, representing the Skoda version of the EA111 engine family, developed by Volkswagen AG. The twin charged engine is equipped with a supercharger and a turbo charger, including charge air cooler. The test procedure is performed with new 6-hole injectors, type 03C906036E/F from Bosch or Magneti Marelli. The injector run-in procedure is performed at high load for 4 hours. The test procedure is a steady state test at an engine speed of 2000 rpm and a constant torque of 56 Nm (=5 bar mean effective pressure). The thermostat is in serial condition.

Nozzle coking is measured as change of injection timing. Due to nozzle coking, the hole diameter of the injector holes is reduced and the injection time adjusted by the Engine Control Unit (ECU) accordingly. The injection time in milliseconds is a direct readout from the ECU via ECU control software. The clean-up procedure starts with a dirty up phase of 48 hours deposit formation with the RF-83 (SP95 E0) reference fuel with a continuous measurement of the increase of injection time, followed with additized fuel for 24 hours. Ideally the injection time reaches the initial value of the test run.

A linear trend calculation at start of test and end of test defines the nozzle coking during 48 hours of dirty up phase. The total nozzle coking after 48 hours is the reference for the recovery calculation during the 24 hours clean up phase. Different detergents have been compared at a treat rate of 100 mg/kg of active material in a gasoline of type SP95 $E_0$ CEC RF-83: the DAQ-salicylate according to the invention and detailed in example 1, a quaternary ammonium derived from a PIBSI (Quat. PIBSI) as described in WO2006135881 and a commercially available polyisobutyleneamine from BASF (PIB-amine). The results are indicated in table 4, as well as the time needed to reach 100% of scrubbing.

TABLE 4

| clean up results of the VW EA111 test | | |
|---|---|---|
| Detergents | Recovery potential calculated | Time to reach 100% recovery |
| Quat. PIBSI | 100% | 12 hours |
| PIB-amine | 93% | More than 24 hours |
| DAQ-salicylate | 100% | 3 hours |

The results of table 4 show that the compound of formula (I) according to the invention provides excellent scrubbing performances in a gasoline fuel, in particular better scrubbing performances than the detergents of the prior art since it allows 100% of scrubbing after only 3 hours when the quaternary ammonium derived from a PIBSI allows 100% of scrubbing after 12 hours.

DISI Test: The Method is the Same as Previously Described for the Keep Clean Procedure.

In this case, tests have been conducted on the "clean-up" procedure to investigate the ability of the different samples to remove existing deposits from DISI injectors. This second type of procedure consists of a set of two consecutive tests. The first test (called "dirty-up" test) is run with a non additivated fuel, which leads to a certain level of injector fouling. Once the flow measurements of the injectors have been done, the fouled injectors are mounted back on the engine and a second test, using and additivated fuel is run. At the end of this test, the resulting injector fouling is compared to the one after the dirty-up test. This procedure allows evaluating the ability of the additives to remove existing deposits from fouled injectors with the aim of restoring their initial cleanliness level.

Different detergents have been compared at a treat rate of 100 mg/kg of active material in the CEC RF-83 gasoline: the DAQ-salicylate according to the invention and detailed in example 1 and a quaternary ammonium derived from a PIBSI (Quat. PIBSI) as described in WO2006135881. The results are indicated in table 5.

TABLE 5

| clean up results of the in-house DISI test | |
|---|---|
| Detergents | Injector flow recovery |
| Quat. PIBSI | 18% |
| DAQ-mC | 93% |

The results of table 5 show that the compound of formula (I) according to the invention provides excellent scrubbing performances in a gasoline fuel, in particular better scrubbing performances than the detergents of the prior art since it allows the higher flow recovery.

Example 6: Valve-Sticking Properties of a Gasoline Fuel

Different gasoline fuel compositions have been prepared: each gasoline fuel (SP98 E5 type) have been supplemented with 300 mg/kg of one additive. Different additives have been used:

- a compound of formula (I): DAQ-mC defined in example 1 and
- three comparative detergent additives: a quaternary ammonium derived from a PIBSI (Quat. PIBSI) as described in WO2006135881, a commercially available polyisobutyleneamine (PIB-amine) from BASF and a commercially available Mannich base from AFTON CHEMICAL LTD (UK).

The sticking level of the valves can be determined using the CEC F-16-T96 Standard Engine Test Method. This method involves running a spark-ignition gasoline engine according to operating points described in the method, then stopping it and gradually lowering the temperature from +90° C. to +5° C. for 10 hours (temperature of the cooling liquid) and then maintain it at +5° C. for another 5 h. Then, cylinder compression measurements are made, which reflect the quality of the seal in the combustion chamber. Failure to reach the reference compression pressure of one or more cylinders indicates the presence of a valve sticking phenomenon. The result of the test is expressed as "NO" if no sticking is observed and "YES" otherwise. The results are indicated in table 6.

TABLE 6 valve-sticking results

| Detergents | Valve sticking |
|---|---|
| DAQ-mC | NO |
| Quat. PIBSI | YES |
| PIB-amine | YES |
| Mannich base | YES |

As can be observed in table 6, only the compound of formula (I) according to the invention allows preventing the valve-sticking phenomenon.

Example 7: Demulsifying Properties of a Diesel Fuel

Different diesel fuel compositions have been prepared: each diesel fuel (B7 type) have been supplemented with 100 mg/kg of one additive. Different additives have been used:

- two different compounds of formula (I): DAQ-mC and DAQ-salicylate defined in example 1; and
- three comparative detergent additives: a quaternary ammonium derived from a PIBSI (Quat. PIBSI) as described in WO2006135881, a commercially available polyisobutyleneamine (PIB-amine) from BASF and a PIBSI as described in U.S. Pat. No. 3,172,892 or WO9812282.

The demulsifying properties of fuel compositions have been evaluated according to ASTM D 1094 standard. In this test, 20 mL of a buffer solution and 80 mL of a fuel composition to be tested are introduced into a graduated test tube of 100 mL. The graduated test tube is then stirred during 2 minutes before being placed onto a flat surface. Two parameters are then recovered:

- the volume of the aqueous phase, located in the inferior part of the test tube is determined after 5 minutes by simple reading of the volume indicated on the graduated test tube,
- the time needed to recover 15 mL of clear water.

The time needed to recover 15 mL of water in each diesel fuel composition is indicated in table 7 below.

TABLE 7 demulsifying property results

| | Time (in second) to recover 15 mL of water |
|---|---|
| Diesel fuel without additive (reference) | 18 |
| Quat. PIBSI | >300 |
| PIBSI | >300 |
| PIB-amine | >300 |
| DAQ-salicylate | 150 |
| DAQ-mC | 120 |

The compounds of formula (I) according to the invention are the compounds that are less harmful for the demulsifying property of the diesel fuel allowing recovering 15 mL of introduced water in only 150 and 120 seconds for DAQ-salicylate and DAQ-mC respectively, whereas for the detergent additives of the prior art need more than 300 seconds are needed.

Another demulsifying property of each diesel fuel composition has been evaluated. The volume of water of each diesel fuel supplemented with 100 mg/kg of an additive, after 5 minutes of rest has been measured and the results are indicated in table 8 below.

TABLE 8 demulsifying property results

| | Volume of water (mL) after 5 minutes of rest |
|---|---|
| Diesel fuel without additive (reference) | 16 |
| Quat. PIBSI | 11 |
| PIBSI | 10 |
| PIB-amine | 15 |
| DAQ-salicylate | 19 |
| DAQ-mC | 20 |

The compounds of formula (I) according to the invention allow recovering 100% of the introduced water after 5 minutes whereas with the comparative detergent additives of the prior art, a substantial amount of water remains trapped in emulsion.

Example 8: Demulsifying Properties in a Gasoline Fuel

Two gasoline fuel compositions have been prepared: each gasoline fuel (SP95 $E_0$ type) have been supplemented with 300 mg/kg of one additive. Two additives have been used:

- a compound of formula (I): DAQ-mC defined in example 1 and
- a comparative detergent additive: a quaternary ammonium derived from a PIBSI (Quat. PIBSI) as described in WO2006135881.

The volume of water of each gasoline fuel supplemented with 300 mg/kg of an additive, after 5 minutes of rest has been measured according to the method described in example 5 and the results are indicated in table 9 below.

TABLE 9

| demulsifying property results | |
|---|---|
| | Volume of water (mL) after 5 minutes of rest |
| Gasoline fuel without additive (reference) | 19 |
| Quat. PIBSI | 16 |
| DAQ-mC | 20 |

The compound of formula (I) according to the invention allows recovering 100% of the introduced water after 5 minutes whereas with the comparative detergent additive of the prior art, a substantial amount of water remains trapped in emulsion.

Example 9: Lubricant Performances in a Gasoline Fuel

Different gasoline fuel compositions have been prepared: each gasoline fuel (SP95 $E_0$ type) have been supplemented with 300 mg/kg of one additive. Different additives have been used:

- a compound of formula (I): DAQ-mC defined in example 1; and
- three comparative detergent additives: a quaternary ammonium derived from a PIBSI (Quat. PIBSI) as described in WO2006135881, a polyisobutyleneamine from BASF (PIB-amine) and a PIBSI as described in U.S. Pat. No. 3,172,892 or WO9812282.

The HFRR (High Frequency Reciprocating Rig) method used here is inspired by the international standard referenced NF EN ISO 12156, "assessment of the lubricant power at high frequency reciprocating bench" of fuels for diesel engines, standard applicable only to diesel. It has been modified to make it applicable to gasolines.

10 ml of sample are placed in a tank maintained at 25° C. A steel ball fixed in a vertical mandrel is rubbed under a constant load of 200 g against a steel plate held fixed and horizontal. The test ball oscillates at a constant frequency of 50 Hz over a fixed stroke of 1.0 mm. The contact takes place in complete immersion in the test liquid. At the end of the test, the diameter of the wear mark is measured and gives an indication of the lubricity power of the gasoline fuel. The wear diameter for each gasoline fuel composition is indicated in table 10 below.

TABLE 10

| HFRR lubricating properties of the fuel | |
|---|---|
| | Wear diameter (μm) |
| gasoline fuel without additive (reference) | 818 |
| Quat. PIBSI | 545 |
| PIBSI | 503 |
| PIB-amine | 830 |
| DAQ-mC | 385.5 |

As can be seen from table 10, the wear with the gasoline fuel composition of the invention, i.e. including the compound of formula (I) is much lower than the wear with the comparative gasoline fuel composition, i.e. including a detergent additive of the prior art. Thus, the compounds of formula (I) defined in the invention can be used as a lubricant additive in a fuel, in particular to reduce wear of internal parts of an engine.

Example 10: Reducing Fuel Consumption Properties in a Diesel or Gasoline Fuel

Different blends have been prepared and evaluated in two engine tests in order to study their ability to improve the fuel economy by measuring the fuel consumption during the tests.

In-House Diesel Off-Road Engine Test:

The method was developed on a STAGE IV DEUTZ TCD3.6 engine (4 cylinders, 3.6 L, 75 kW), which is used by many brands of vehicles (Liebherr, Claas, Manitou . . . ). Two detergents have been compared at a treat rate of 100 mg/kg of active material in the EN590 diesel fuel (B7 type).

DISI (Direct Injection Spark Ignition Gasoline Engine) Test:

Same engine test as already described in Example 4. Tests have been conducted on the "keep-clean" procedure to investigate the performance of the different samples. Two detergents have been compared at a treat rate of 100 mg/kg of active material in the CEC RF-83 gasoline.

For both diesel and gasoline engine tests, the detergents are: the DAQ-mC according to the invention and detailed in example 1, a quaternary ammonium derived from a PIBSI (Quat. PIBSI) as described in WO2006135881, and a commercially available polyisobutyleneamine (PIB-amine) from BASF. The results of the fuel economy tests are highlighted in table 11.

TABLE 11

| Percentage of fuel economy results | | |
|---|---|---|
| Detergent | Diesel test | Gasoline test |
| None | +0.3% | −14.6% |
| Quat. PIBSI | +2.2% | — |
| PIB-amine | — | −4.8% |
| DAQ-mC | +3.8% | −2.2% |

The results of table 11 show that the compound of formula (I) according to the present invention increases fuel economy of an internal combustion engine for diesel, better than the detergents of the prior art since it allows a fuel save of +3.8% compared to the neat fuel. The same compound significantly limits the fuel consumption in the case of the gasoline.

Example 11: Conductivity Improver Properties in a Diesel or Gasoline Fuel

Different fuel compositions have been prepared:

- for diesel fuels: a diesel fuel (B7 type) has been supplemented with 1 mg/kg of one additive,
- for gasoline fuels: a gasoline fuel (SP98 E0 type) has been supplemented with 1 mg/kg of one additive.

Two additive used is: the DAQ-mC compound of formula (I) defined in example 1.

The electrical conductivity of fuel compositions has been evaluated according to ASTM D2624 standard. The test gives a measurement of the conductivity when the fuel is uncharged, that is, electrically at rest (known as the rest conductivity). The results are indicated in table 12.

TABLE 12

| electrical conductivity results (pS/m) | | |
|---|---|---|
| Additive | Diesel | Gasoline |
| None | 155 | 68 |
| DAQ-mC | 178 | 136 |

The electrical conductivity is improved thanks to the addition of DAQmC in the fuel composition.

Example 12: Metal Deactivator Properties in a Diesel Fuel

DW10 Test Determination of Power Loss as a Result of Injector Deposits in the Common Rail Diesel Engine. A specific characteristic of the ability of a fuel composition to deactivate and/or passivate metallic surfaces may consist of decreasing the injector deposits amount. The keep-clean test is based on CEC test procedure F-098-08 Issue 5. This is done using the same test setup and engine type (PEUGEOT DW10B, 4 cylinders, 2.0 L) as in the CEC procedure. Each combustion chamber comprises 4 valves. The injectors are of the piezo DI type satisfying the Euro V classification in terms of emissions.

This test consists of the repetition, consecutively, of a sequence consisting of:

1) to run the engine for 8 hours continuously, and
2) to leave the engine off for 4 hours (soak period).

The previous sequence is performed 3 times in total.

At the end of each hour of operation (step 1), an engine power measurement is performed. The fouling tendency of the injector is then determined by the nominal power difference measured between the beginning and the end of the test cycle.

The operating periods of the engine (step 1)) actually correspond to the repetition of a cycle whose total duration is equal to 1 hour and whose main characteristics are given in Table 13 below. A running phase of the engine (8 hours in total) therefore corresponds to the sequence of 8 cycles as defined in Table 13. Between two sets of tests, the engine is rinsed and the injectors removed for inspection, cleaning, and reinstallation into the engine. In case of change of the injectors, the new injectors undergo, before the implementation of the following series, a run-in cycle of 16 hours. The engine is then operated according to the test cycle and a power measurement at 4,000 rpm and at full load is performed to verify the full restoration of engine power after injector cleaning. As the power measurements conform to the specifications, the next series is started.

TABLE 13

| Step | Duration (min) | Engine speed (rpm) | Load (%) | Torque (Nm) | Charge air cooling (° C.) |
|---|---|---|---|---|---|
| 1 | 2 | 1750 | 20 | 62 | 45 |
| 2 | 7 | 3000 | 60 | 173 | 50 |
| 3 | 2 | 1750 | 20 | 62 | 45 |
| 4 | 7 | 3500 | 80 | 212 | 50 |
| 5 | 2 | 1750 | 20 | 62 | 45 |
| 6 | 10 | 4000 | 100 | — | 50 |
| 7 | 2 | 1250 | 10 | 25 | 43 |
| 8 | 7 | 3000 | 100 | — | 50 |
| 9 | 2 | 1250 | 10 | 25 | 43 |
| 10 | 10 | 2000 | 100 | — | 50 |
| 11 | 2 | 1250 | 10 | 25 | 43 |
| 12 | 7 | 4000 | 100 | | 50 |

Two diesel fuel compositions have been prepared:

a diesel fuel (B7 type) has been supplemented with 1 mg/kg of zinc (Zn) and, the previous diesel fuel composition, additionally supplemented with 75 mg/kg of active material of one additive from the present invention. The results are compiled in Table 14.

TABLE 14

| DW10B power loss results | |
|---|---|
| Detergent | Power loss (%) |
| None | −6.39 |
| DAQ-mC | +2.00 |

The results show that the DAQ-mC additive inhibits the negative effect of the Zn ions since it prevents the engine power loss.

Example 13: Antioxidant Properties in a Diesel Fuel

The antioxidant properties of biodiesel fuel compositions have been evaluated using the modified Rancimat method (method reference EN 15751). Indeed, the oxidation stability is a key parameter of diesel fuel quality which has taken on extra importance as a result of the decrease in stability from desulphurisation and biodiesel blending. In this test, an induction period (in hours) is measured.

Two diesel fuel compositions have been prepared: each diesel fuel (B7 type) have been supplemented with 100 mg/kg of one additive. Two additives have been used:

- a compound of formula (I): DAQ-mC defined in example 1 and
- a comparative detergent additive: a quaternary ammonium derived from a PIBSI (Quat. PIBSI) as described in WO2006135881.

The results are compiled in Table 15.

TABLE 15

| Induction period results | |
|---|---|
| Detergent | Induction period (hours) |
| None | >48 |
| Quat. PIBSI | 29.7 |
| DAQ-mC | >48 |

The compound of formula (I) according to the invention doesn't affect the oxidation stability of the biodiesel blend contrary to the commercial quat PIBSI additive tested.

Example: 14: Effect on Lacquering of Synergistic Combinations Comprising the Compound of Formula (I) of the Invention The same test as the test detailed in example 2 has been used with a diesel composition Bo. Two synergistic combinations according to the invention (Combi1 and Combi2) have been tested and compared with a combination of detergents according to the prior art (Ref1). The following detergents have been used:

DAQ-mC as detailed in example 1 (compound of formula (I) according to the invention).

Quat-PIBSI: a quaternary ammonium derived from a PIBSI, as described in WO2006135881, BET: alkylamidoamine betain with fatty chain comprising from 8 to 30 carbon atoms. Amounts of additives (expressed in ppm of active material) in the diesel compositions and the average flow loss are indicated in table 16.

TABLE 16

Average Flow Loss in diesel compositions

| Additives in the diesel | Combi1 | Combi2 | Ref1. |
|---|---|---|---|
| DAQmC (ppm) | 25 | 10 | — |
| Quat-PIBSI (ppm) | 125 | 125 | 125 |
| BET (ppm) | 125 | 125 | 125 |
| Average Flow Loss (%) | 2.0 | 9.0 | 34.0 |

Adding even a small amount of the compound of formula (I) according to the invention almost completely avoids the formation of fouling.

Example 15: Effect on Injector Flow Loss of Synergistic Combinations Comprising the Compound of Formula (I) of the Invention The injector flow loss has been evaluated in gasoline compositions comprising combinations of additives. The test has been implemented in a direct injection 3-cylinder engine EDB2DTS of PSA. The gasoline in this example is a gasoline SP95 E10 according to standard NF EN 228. The flow loss between before the test is compared with the flow loss after the test. Different combinations of additives have been tested.

The following additives have been used:

DAQ-mC as detailed in example 1 (compound of formula (I) according to the invention).

PIBSI as described in U.S. Pat. No. 3,172,892 or WO9812282.

a commercially available Mannich base from AFTON CHEMICAL LTD (UK).

a carrier oil of type propoxylated dodecylphenol, used at a treat rate corresponding to a mass ratio carrier oil/detergent=0.6.

Amounts of additives (expressed in ppm of active material) in the gasoline compositions and the flow loss are indicated in table 17.

TABLE 17

Average Flow Loss in gasoline compositions

| | Ref2 (gasoline alone) | Ref3 | Ref4 | Combi3 | Combi4 |
|---|---|---|---|---|---|
| DAQmC (ppm) | 0 | 0 | 0 | 45 | 10 |
| PIBSI (ppm) | 0 | 0 | 45 | 0 | 35 |
| Mannich base (ppm) | 0 | 250 | 250 | 250 | 250 |
| Average Flow Loss (%) | 15.3% | 16.2% | 7.7% | 8.2% | 6.2% |

Those examples show that there is a synergy between the compound of formula (I) according to the invention and another detergent additive of type PIBSI since the combination Combi4 provides a lower flow loss than Combi3 comprising only the compound of formula (I) according to the invention and better than Ref4 comprising only the other detergent additive of type PIBSI.

What is claimed is:

1. A fuel composition comprising:

(i) a liquid fuel, and (ii) a compound of formula (I):

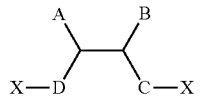

(I)

wherein

A, B, C and D represent, independently to each other, an alkyl or an alkenyl group with a number of carbon atoms resulting in a molar mass of A+B+C+D ranging from 84 to 10000 g/mol, wherein A is optionally hydrogen;

each X represents independently to each other the monovalent radical of formula (II):

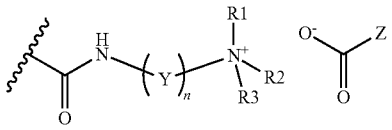

(II)

wherein:

each R1, R2, R3, identical or different, represent $C_1$-$C_{20}$ linear or branched, saturated or unsaturated, cyclic or acyclic, hydrocarbyl group;

each Y represents a $C_1$-$C_{20}$ linear or branched, saturated or unsaturated, hydrocarbyl group optionally substituted by a functional group comprising oxygen and/or a nitrogen atom(s);

each n represents an integer ranging from 1 to 20; and

Z represents a $C_1$-$C_{16}$, linear or branched, saturated or unsaturated, cyclic or acyclic, hydrocarbyl group optionally substituted by a functional group comprising an oxygen and/or a nitrogen atom.

2. The fuel composition according to claim 1, wherein Z is selected from alkyl, alkenyl or aryl groups, optionally substituted by a functional group comprising oxygen and/or a nitrogen atom(s), having a molar mass less than 237 g/mol.

3. The fuel composition according to claim 1, wherein Y represents a $C_1$-$C_{12}$ linear or branched, saturated or unsaturated, hydrocarbyl group constituted by carbon atoms and hydrogen atoms and/or n ranges from 1 to 6.

4. The fuel composition according to claim 1, wherein A, B, C and D represent, independently to each other, an alkyl or an alkenyl group with a number of carbon atoms resulting in a molar mass of A+B+C+D ranging from 84 to 2000 g/mol.

5. The fuel composition according to claim 1, wherein R1, R2, R3 are identical and selected from alkyl groups having from 1 to 12 carbon atoms.

6. The fuel composition according to claim 1, wherein the compound is of formula (Ib):

(Ib)

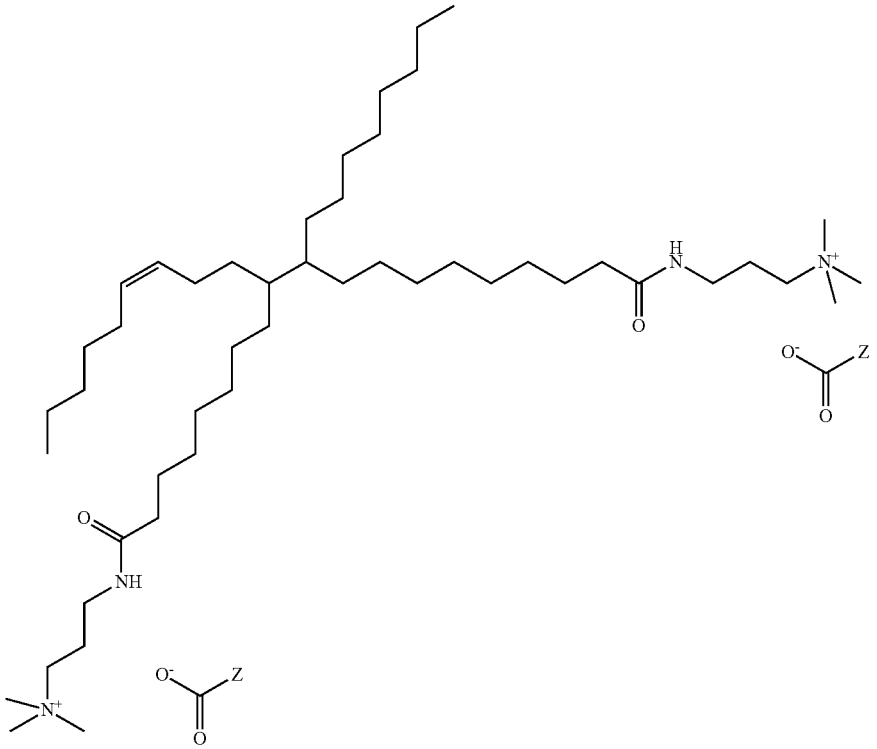

wherein Z represents a $C_1$-$C_{16}$, linear or branched, saturated or unsaturated, cyclic or acyclic, aliphatic or aromatic hydrocarbyl group optionally substituted by a functional group comprising an oxygen and/or a nitrogen atom.

7. The fuel composition according to claim 1, wherein the liquid fuel is selected from diesel fuels and gasoline fuels.

8. The fuel composition according to claim 7, which is a diesel fuel composition further comprising at least one betaine compound.

9. The fuel composition according to claim 7, which is a gasoline fuel composition further comprising a Mannich base.

10. The fuel composition according to claim 7, which is a gasoline fuel composition further comprising a polyisobutylene succinimide compound.

11. The fuel composition according to claim 1, further comprising at least 5 ppm by weight of the compound of formula (1).

12. A method of using a compound of formula (I):

(I)

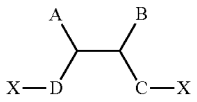

wherein

A, B, C and D represent, independently to each other, an alkyl or an alkenyl group with a number of carbon atoms resulting in a molar mass of A+B+C+D ranging from 84 to 10000 g/mol, being understood that A is optionally hydrogen;

each X represents independently to each other the monovalent radical of formula (II):

(II)

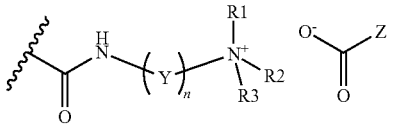

wherein:

each R1, R2, R3, identical or different, represent $C_1$-$C_{20}$ linear or branched, saturated or unsaturated, cyclic or acyclic, hydrocarbyl group;

each Y represents a $C_1$-$C_{20}$ linear or branched, saturated or unsaturated, hydrocarbyl group optionally substituted by a functional group comprising oxygen and/or a nitrogen atom(s);

each n represents an integer ranging from 1 to 20; and

Z represents a $C_1$-$C_{16}$, linear or branched, saturated or unsaturated, cyclic or acyclic, hydrocarbyl group optionally substituted by a functional group comprising an oxygen and/or a nitrogen atom;

adding the compound as a detergent additive and/or as a demulsifying additive and/or as a lubricant additive and/or as a corrosion inhibitor additive and/or as an antioxidant additive and/or as a conductivity improver and/or as a metal deactivator, in a liquid fuel for an internal combustion engine.

13. The method according to claim 12, wherein in the compound of formula (I), Z is selected from alkyl, alkenyl or aryl groups, optionally substituted by a functional group comprising oxygen and/or a nitrogen atom(s), having a molar mass less than 237 g/mol.

14. The method according to claim 12, wherein the liquid fuel is selected from diesel fuels and gasoline fuels.

15. The method according to claim 12 wherein the compound(s) of formula (I) is(are) added in the liquid fuel in an amount of at least 5 ppm by weight.

16. The method according to claim 12 further comprising limiting or preventing formation of deposits in at least one internal part of the engine and reducing existing deposits in the at least one internal part of the engine, with the compound of formula (I) in the liquid fuel.

17. The method according to claim 12, further comprising reducing fuel consumption of the engine, with the compound of formula (I).

18. The method according to claim 12, further comprising using the compound of formula (I) in combination with:

at least one quaternary ammonium compound different from compounds of formula (I), and at least one alkylamidoamine betaine; or at least one phenol Mannich base, and at least one polyisobutylene succinimide compound, or at least alkylamidoamine betaine.

* * * * *